US009760053B2

(12) United States Patent
Toda

(10) Patent No.: US 9,760,053 B2
(45) Date of Patent: Sep. 12, 2017

(54) POST-PROCESSING DEVICE AND IMAGE FORMING APPARATUS

(71) Applicant: KONICA MINOLTA, INC., Chiyoda-ku, Tokyo (JP)

(72) Inventor: Hiromichi Toda, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/827,847

(22) Filed: Aug. 17, 2015

(65) Prior Publication Data

US 2016/0054696 A1 Feb. 25, 2016

(30) Foreign Application Priority Data

Aug. 20, 2014 (JP) ..... 2014-167203

(51) Int. Cl.
*B65H 31/34* (2006.01)
*B41J 29/38* (2006.01)
*G03G 15/00* (2006.01)

(52) U.S. Cl.
CPC ..... *G03G 15/6538* (2013.01); *G03G 15/6541* (2013.01); *G03G 15/6547* (2013.01); *G03G 2215/00126* (2013.01); *G03G 2215/00827* (2013.01)

(58) Field of Classification Search
CPC ..... B65H 2408/1144; B65H 2301/362; B65H 2301/3621; B65H 2301/363; B65H 31/34; B65H 2408/114; B65H 31/3081; B41J 13/0036; B41J 11/0025; B41J 13/0054; G03G 15/6547; G03G 2215/00421; G03G 15/6573
See application file for complete search history.

(56) References Cited

U.S. PATENT DOCUMENTS 5,984,299 A * 11/1999 Hirota ..... B65H 31/14 271/161
6,357,736 B1 * 3/2002 Kubota ..... B65H 31/3081 270/58.08
2002/0056962 A1 * 5/2002 Mori ..... B65H 3/0669 271/242
2006/0055766 A1 * 3/2006 Kawata ..... G03G 15/50 347/164

FOREIGN PATENT DOCUMENTS

JP 2005132616 A 5/2005
JP 2005194104 A 7/2005
JP 2005350186 A * 12/2005 ..... B65H 31/34

* cited by examiner

*Primary Examiner* — Matthew G Marini
*Assistant Examiner* — Ruben Parco, Jr.
(74) *Attorney, Agent, or Firm* — Holtz, Holtz & Volek PC

(57) ABSTRACT

A post-processing device for applying a post-process to a sheet fed from a device of a preceding stage is provided. The post-processing device includes a holding tray; an alignment mechanism; an output mechanism; and a control unit. In the case where a first sheet and a second sheet are different in size, the control unit performs a control in such a manner that, when the first sheet is fed, the alignment mechanism or the output mechanism shifts the first sheet to match the side edge of the first sheet and the side edge of the second sheet to be fed following the first sheet, and that, after the second sheet is fed, the output mechanism outputs the sheet bundle.

18 Claims, 15 Drawing Sheets

(A) CASE OF NO PRESHIFTING (B) CASE OF PRESHIFTING (A) CASE OF NO PRESHIFTING

Prior Art (B) CASE OF PRESHIFTING

POST-PROCESSING DEVICE AND IMAGE FORMING APPARATUS

This application is based on Japanese patent application No. 2014-167203 filed on Aug. 20, 2014, the contents of which are hereby incorporated by reference.

BACKGROUND OF THE INVENTION

1. Field of the Invention

The present invention relates to a post-processing device for applying a post-process to one or more sheets fed thereinto from a device of a preceding stage, and an image forming apparatus.

2. Description of the Related Art

An image forming apparatus for printing an image onto paper (sheet), e.g., printer, copier, or Multi-functional Peripheral (MFP, or, multi-functional device), is provided with a paper containing portion in which lots of sheets of paper are loadable and from which the paper is supplied. Such an image forming apparatus supplies the sheets of paper one by one from the paper containing portion, conveys the sheets of paper, and prints an image thereonto.

In most cases, the image forming apparatus is internally or externally provided with a post-processing device for applying a post-process to paper on which an image has been printed. The post-processing device (finisher) applies a post-process called "alignment process" of aligning accumulated sheets of paper fed into a holding tray after the printing. Some post-processing devices are provided with a stapler for stapling a sheet bundle that has been subjected to the alignment process, a punching mechanism for punching a hole in the sheets that have been subjected to the alignment process, and so on.

In an image forming apparatus having such a post-processing device, the problem is how to operate the post-processing device when a plurality of sheets of paper having different sizes is used.

There has been disclosed a technology in which a start time of alignment operation is set to a late time for a sheet having a large size, and the start time is set to an early time for a sheet having a small size. According to the technology, alignment of sheets having a large size is secured, and at the same time, the productivity of printing involving the use of sheets having a small size is improved (Japanese Laid-open Patent Publication No. 2005-194104).

There has been proposed a post-processing device which is employed in printing involving the use of a plurality of sheets having a uniform width but different lengths. The post-processing device is capable of aligning the trailing edges of the sheets when a condition that a preceding sheet is longer than the successive sheet is satisfied (Japanese Laid-open Patent Publication No. 2005-132616).

Conventional post-processing devices have less-restricted space constraints. Thus, it is possible to dispose an output tray, in which sheets having been subjected to a post-process are kept and from which a user takes the sheets, on a downstream of the sheet feed direction to a holding tray. Stated differently, the sheet feed direction to the holding tray can be set to a direction which is the same as the output direction from the holding tray to the output tray.

However, a demand for space-saving in an image forming apparatus recently has been raised. Further, sever space constraints have been put onto a post-processing device. In particular, a demand for downsizing of an inner finisher provided inside the image forming apparatus has been increased. For this reason, the output tray cannot be disposed in a downstream of the holding tray. The output tray, therefore, has to be disposed at a position at which the output direction is orthogonal to the feed direction. For example, if the feed direction corresponds to the right to left direction of the image forming apparatus, then the output tray is supposed to be disposed in the front (or the rear) of the holding tray.

With a post-processing device having a configuration in which the feed direction is orthogonal to the output direction, when a first sheet of paper and a second sheet of paper which are different in width (the size in the width direction orthogonal to the conveyance direction) are sequentially fed into a holding tray for alignment, the second sheet of paper has to be fed into the holding tray after the first sheet of paper is discharged from the holding tray. This is because it is difficult to align the first sheet of paper and the second sheet of paper overlapping with both ends thereof in the width direction shifted from each other. The alignment in such a case is a process to put together one end of the sheets of paper in the width direction. For the alignment, however, an alignment mechanism having a complicated structure is required. Such a complicated alignment mechanism cannot be provided in a compact post-processing device such as the inner finisher.

It may be possible to omit the application of alignment process to the first and second sheets of paper overlapping with both ends thereof in the width direction shifted from each other, and, to discharge the first and second sheets of paper with both ends thereof shifted from each other from the holding tray.

When the sheets of paper are discharged without the alignment process, and when a push-out member for the discharge is pressed onto the sheets of paper to move the same, the push-out member first contacts one of the sheets having a larger width to move the same. At this time, a sheet having a smaller width is probably dragged and moved with the sheet having a larger width. When being dragged and moved, the edge of the sheet having a smaller width often skews with respect to the output direction. In short, the sheets of paper overlapping each other are further misaligned in many cases as compared to the case before the start of output of the sheets of paper.

The misalignment of sheets of paper lowers the quality (appearance) of output. Unpreferably, the skewed sheets outputted may fall from the output tray.

In order to prevent such unpreferable situations from occurring, as discussed earlier, the second sheet of paper has to be fed into the holding tray after the first sheet of paper is discharged from the holding tray in the conventional technologies.

In view of this, in conventional technologies, of mixed-printing type involving the use of a plurality of sheets of paper with different sizes, in printing involving the use of a plurality of sheets of paper with different widths (hereinafter, such printing being referred to as "mixed-printing"), every time when the width of a sheet fed into the post-processing device is changed from the width of a preceding sheet fed thereinto, the post-processing device is supposed to perform output operation. Since feeding the next sheet of paper is stopped until the output operation is completed, the mixed-printing involves a wait time called "wait" between the feed of a preceding sheet of paper and the feed of a subsequent sheet of paper. In short, unfortunately, the mixed-printing is less productive than normal printing which involves the use of sheets of paper of uniform size.

SUMMARY

The present disclosure has been achieved in light of such an issue, and therefore, an object of an embodiment of the present invention is to improve the productivity of mixed-printing processes involving the use of a plurality of sheets of paper with different sizes.

A post-processing device according to an embodiment of the present invention is a post-processing device for applying a post-process to a sheet fed from a device of a preceding stage. The post-processing device includes a holding tray configured to keep a sheet fed, from the device of the preceding stage, evenly with respect to a centerline of the device of the preceding stage; an alignment mechanism configured to apply an alignment process to a sheet bundle of one or more sheets put in the holding tray; an output mechanism configured to output the sheet bundle to a paper output tray by pushing a side edge of the sheet bundle put in the holding tray with a push-out member to move the sheet bundle in a direction orthogonal to a sheet feed direction; and a control unit; wherein, in a case where a first sheet which is a sheet included in the sheet bundle and a second sheet which is a sheet to be fed following the first sheet are different in size, the control unit performs a control in such a manner that, when the first sheet is fed, the alignment mechanism or the output mechanism shifts the first sheet to match the side edge of the first sheet and the side edge of the second sheet to be fed following the first sheet, and that, after the second sheet is fed, the output mechanism outputs the sheet bundle.

These and other characteristics and objects of the present invention will become more apparent by the following descriptions of preferred embodiments with reference to drawings.

DESCRIPTION OF THE PREFERRED EMBODIMENTS

Figure 1:
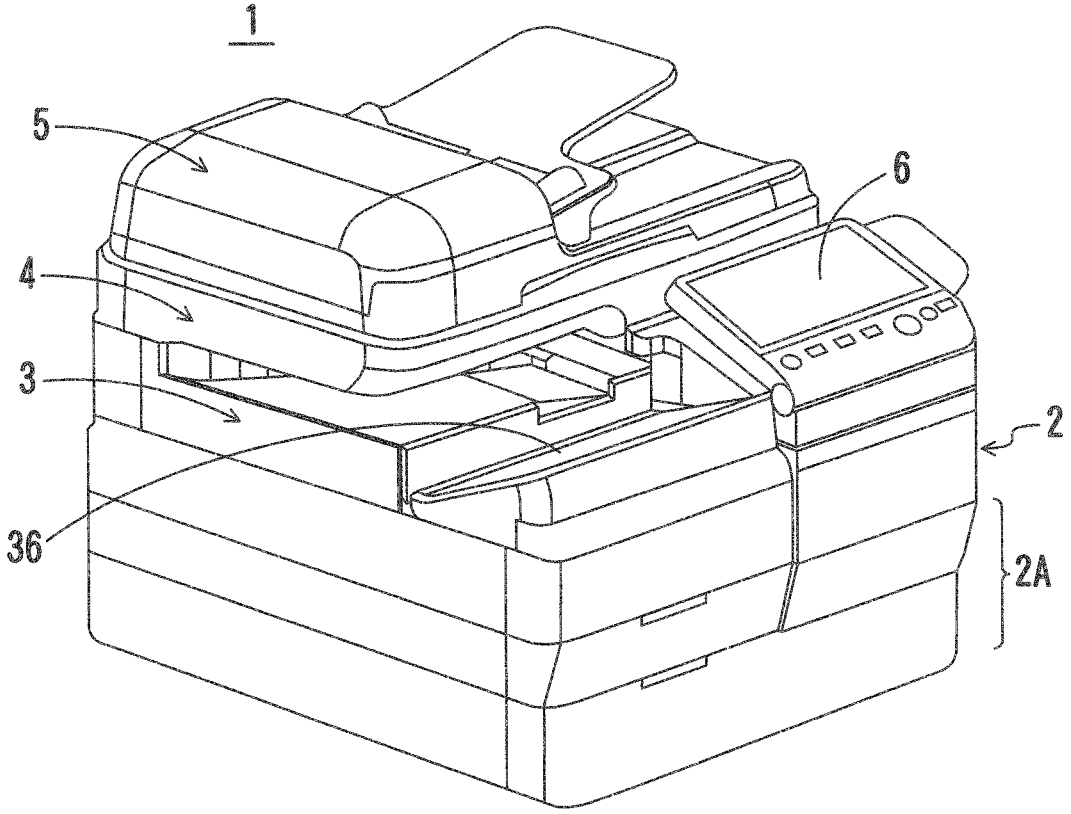
FIG. 1 is a perspective view showing an example of the external view of an image forming apparatus having a finisher according to an embodiment of the present invention.

FIG. 1 shows an example of the external view of an image forming apparatus 1 having a finisher according to an embodiment of the present invention.

Referring to FIG. 1, the image forming apparatus 1 is an MFP into which a printer 2, a finisher 3, and an image scanner 4 are integrated.

To be specific, the image forming apparatus 1 is of a compact type in which a paper output tray 36 is provided on the front (front face) of the finisher 3. The finisher 3 is provided on the printer 2. The flatbed image scanner 4 is provided above the finisher 3. There is a space opening to outside between the finisher 3 and the image scanner 4. The printer 2 projects to the front beyond the front end of the image scanner 4. The paper output tray 36 and an operating panel 6 are provided on the projecting part of the printer 2.

The printer 2 has a slide-out paper housing portion 2A with a two-stage part for loading sheets of paper thereinto. In response to a print command, the printer 2 performs printing, through electrophotography, onto a supplied sheet of paper based on image data. The sheet on which printing has been performed is sent out to the finisher 3 evenly with respect to the centerline TS (see FIG. 4) which is the center of the machine, i.e., through paper central passage in which the paper passage center coincides with the center of the machine.

In response to a command to perform printing onto a plurality of sheets of paper, the printer 2 continuously performs print operation at a predetermined system speed, and sends out the printed sheets of paper to the finisher 3 with predetermined time intervals. However, when receiving from the finisher 3 a particular command related to timing, for example, a "wait" command, then control is so performed that print operation or sheet conveyance is stopped and no sheets of paper are sent out to the finisher 3 until the "wait" command is cancelled, or, alternatively, until a predetermined time has elapsed.

The finisher (post-processing device) 3 applies a post-process to the sheets of paper fed thereinto from the printer 2 which is a device of a preceding device. The image scanner 4 optically reads an image from a document sheet. The image scanner 4 is attached to an Auto Document Feeder (ADF) 5 for automatically feeding a document sheet. The operating panel 6 is provided with a touch panel display for displaying a screen and detecting a touch input.

A user uses the image forming apparatus 1 as a copier, printer, facsimile machine, network scanner, and so on.

Figure 2:
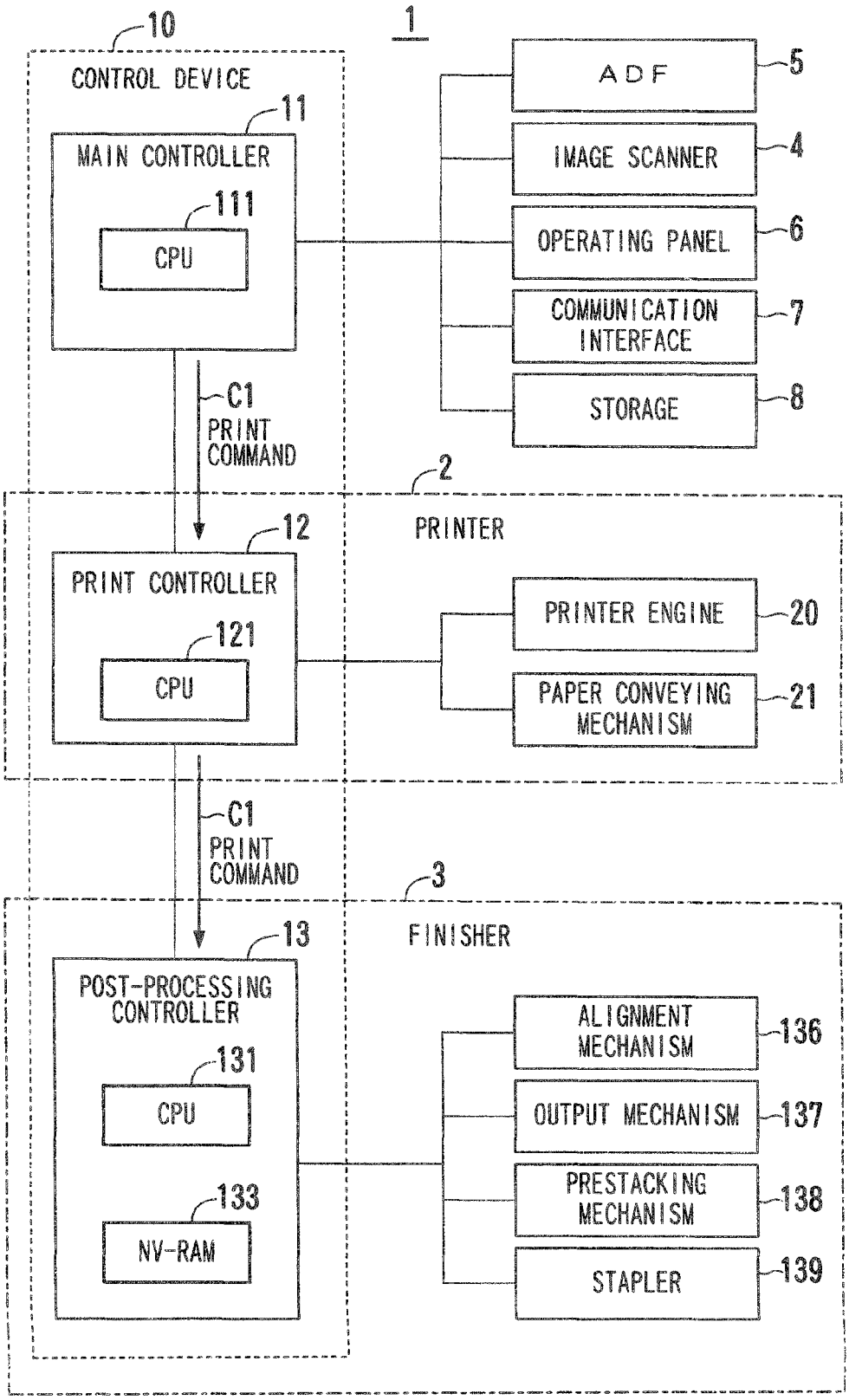
FIG. 2 is a block diagram showing the outline of the hardware configuration of an image forming apparatus.
Figure 3:
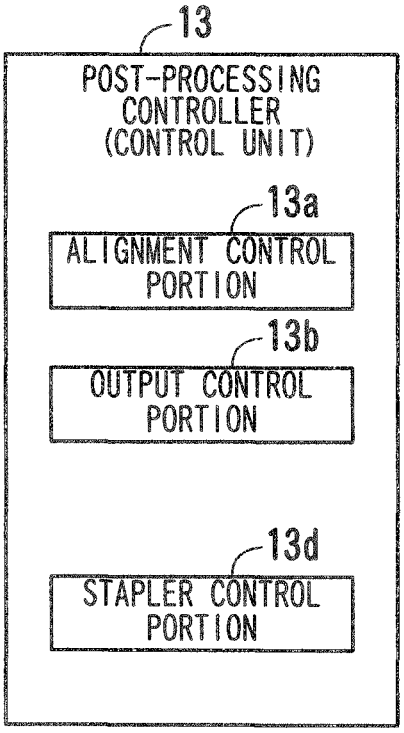
FIG. 3 is a block diagram showing an example of the configuration of a control unit of a finisher.
Figure 4:
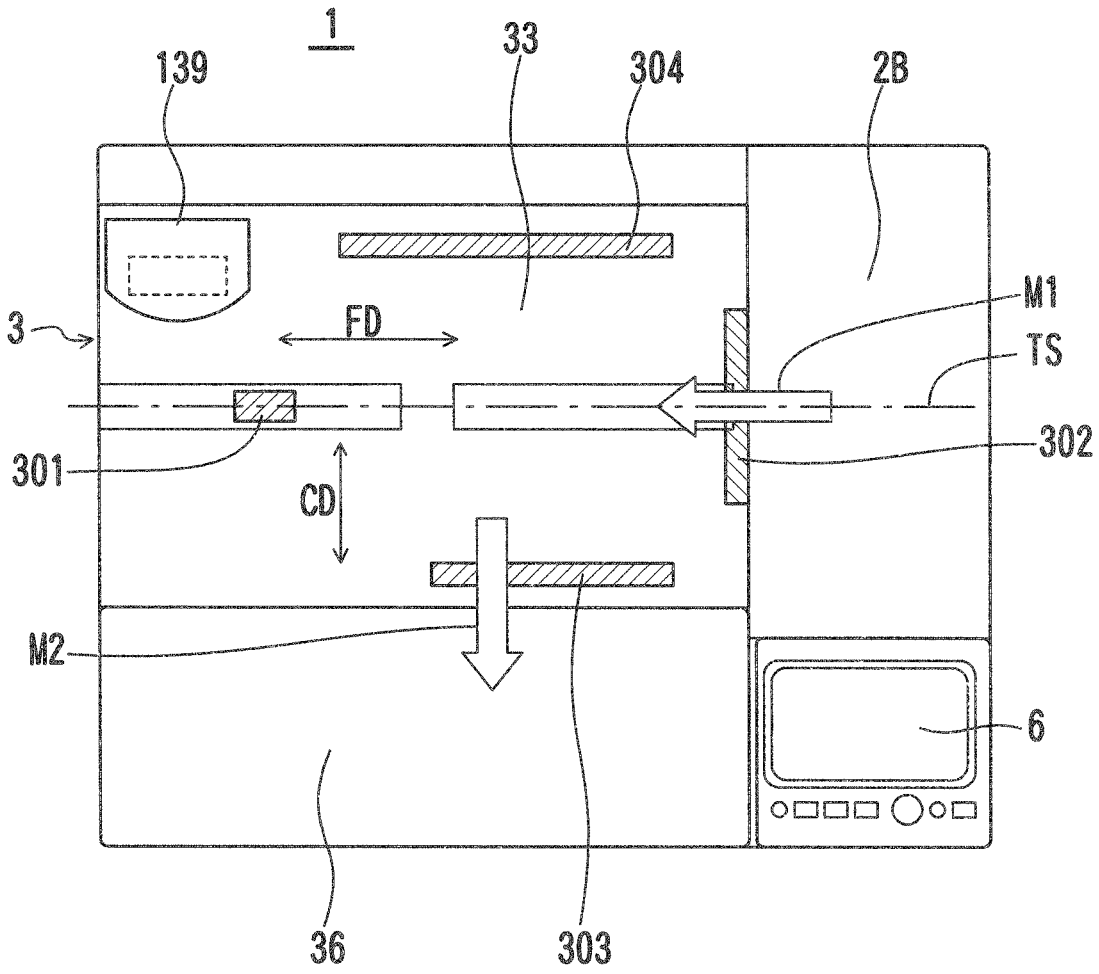
FIG. 4 is a plan view showing an example of the structure near a holding tray of a finisher.

FIG. 2 is a block diagram showing the outline of the hardware configuration of the image forming apparatus 1. FIG. 3 shows an example of the configuration of a control unit of the finisher 3. FIG. 4 shows an example of the structure near a holding tray 33 of the finisher 3.

Referring to FIG. 2, the image forming apparatus 1 has a control device 10 for controlling the printer 2 and the finisher 3. The control device 10 includes a main controller 11, a print controller 12, and a post-processing controller 13. The controllers 11, 12, and 13 have Central Processing Units (CPUs) 111, 121, and 131, respectively which serve as computers to execute the individual control programs. Each of the controllers 11, 12, and 13 also has a Random Access Memory (RAM), a Read Only Memory (ROM), and an interface, all of which are not shown in the drawing.

The main controller 11 serves to control an overall operation of the image forming apparatus 1. The main controller 11 performs communication with each of the ADF 5, the image scanner 4, the operating panel 6, a communication interface 7, a storage 8, and the print controller 12 to send/receive data and commands thereto/therefrom. The main controller 11 performs communication also with the post-processing controller 13 through the print controller 12. The main controller 11 receives a job entered by the user using the operating panel 6 or entered through access from an external device through the communication interface 7, and gives a control target a command corresponding to the entered job.

The print controller 12 serves to control a printer engine 20 and a paper conveying mechanism 21. In a print job, the print controller 12 controls the printer 2 to perform print operation in accordance with a print command C1 (including a print preparation command and a subsequent print start command) from the main controller 11. At this time, the print controller 12 sends, to the post-processing controller 13, information necessary to control the finisher 3, e.g., information on paper size, the number of prints, the set of prints, and the progress of paper conveyance.

The post-processing controller 13 serves as the control unit of the finisher 3 to control an alignment mechanism 136, an output mechanism 137, and a stapler 139. The post-processing controller 13 and the print controller 12 work in coordination to control the finisher 3 to carry out a series of operation of performing an alignment process on post-printing paper and discharging the paper in accordance with a pace of operation of the printer 2.

The alignment mechanism 136 applies an alignment process to a sheet bundle (paper bundle) PT including one or more sheets of paper P put in the holding tray 33. The holding tray 33 is a rest for alignment in which one or more printed sheets of paper P fed thereinto from the printer 2 are held. The holding tray 33 is ready to receive the sheet bundle PT including a plurality of types of sheets with different sizes. The sheet bundle PT is a target of an alignment process by the alignment mechanism 136.

The alignment mechanism 136 applies an alignment process by center-alignment to a sheet bundle PT including a plurality of sheets of paper P of uniform size. With the center-alignment, both side edges of the sheets of paper P are pressed to make the center of the sheets of paper P correspond to the center of the machine. This makes the sheets of paper P even and symmetric with respect to the centerline TS.

With the output mechanism 137, a push-out member (rear movable guide 304) pushes the side edge (end in the width direction) of the sheet bundle PT in the holding tray 33. This moves the sheet bundle PT in a direction orthogonal to the paper feed direction to output the sheet bundle PT to the paper output tray 36.

A prestacking mechanism 138 temporarily keeps, in the upstream of the holding tray 33, paper P next fed from the printer 2 of a preceding stage until the output mechanism 137 outputs the sheet bundle PT.

With a stapling mode set, the stapler 139 applies a stapling process to the sheet bundle PT. The stapler 139 is provided on, for example, a paper feed path to the paper output tray 36 to which the sheet bundle PT in the holding tray 33 is outputted. The stapler 139 is disposed at such a position that the stapler 139 can apply the stapling process to the sheet bundle PT and the sheet bundle PT is passable through an opening of the stapler 139.

Suppose that a first sheet of paper P1 which is paper P included in the sheet bundle PT and a second sheet of paper P2 which is paper P fed following the first sheet of paper P1 are different in size. In such a case, when the first sheet of paper P1 is fed, i.e., in advance before the second sheet of paper P2 is fed, the post-processing controller 13 controls the finisher 3 to shift the first sheet of paper P1 by the alignment mechanism 136 or the output mechanism 137 in such a manner that the side edge of the first sheet of paper P1 matches the side edge of the second sheet of paper P2 fed following the first sheet of paper P1, and then controls the finisher 3 to output the sheet bundle PT by the output mechanism 137 after the second sheet of paper P2 is fed.

In the case where, after the second sheet of paper P2 is fed, a third sheet of paper P3 which is paper P having a size different from that of the second sheet of paper P2 is fed, the post-processing controller 13 performs a control in such a manner that, before the third sheet of paper P3 is fed, the sheet bundle PT including the first sheet of paper P1 and the second sheet of paper P2 is outputted.

Before the sheet bundle PT including the first sheet of paper P1 and the second sheet of paper P2 is outputted, the post-processing controller 13 performs a control in such a manner that an alignment member (trailing edge alignment guide 302) of the alignment mechanism 136 shifts the first sheet of paper P1 or the second sheet of paper P2 to match the trailing edge of the first sheet of paper P1 and the trailing edge of the second sheet of paper P2 in the paper feed direction. The post-processing controller 13 performs a control in such a manner that the push-out member pushes the side edge of the first sheet of paper P1 and the side edge of the second sheet of paper P2 to output the first sheet of paper P1 and the second sheet of paper P2 with the trailing edges thereof contacting the alignment member.

Suppose that the third sheet of paper P3 which is paper P having a size different from that of the second sheet of paper P2 is fed after the second sheet of paper P2 is fed. Even in such a case, when the third sheet of paper P3 has an area smaller than that of the second sheet of paper P2, i.e., when the sheet of paper P3 is smaller than the sheet of paper P2, the post-processing controller 13 performs a control in such a manner that, after the third sheet of paper P3 is fed, the sheet bundle PT including the third sheet of paper P3, the first sheet of paper P1, and the second sheet of paper P2 is outputted. In contrast, when the third sheet of paper P3 has an area larger than that of the second sheet of paper P2, the post-processing controller 13 performs a control in such a manner that, before the third sheet of paper P3 is fed, the sheet bundle PT including the first sheet of paper P1 and the second sheet of paper P2 is outputted.

Suppose that the third sheet of paper P3 which is paper P having a size, particularly, a dimension in the width direction, different from that of the second sheet of paper P2 is fed after the second sheet of paper P2 is fed. In such a case, when the third sheet of paper P3 has an area smaller than that of the second sheet of paper P2, and at the same time, when the side edge of the third sheet of paper P3 fed extends beyond the side edge of the second sheet of paper P2, the post-processing controller 13 performs a control in such a manner that the third sheet of paper P3 is fed, the alignment member aligns the trailing edges of the third sheet of paper P3, the first sheet of paper P1, and the second sheet of paper P2, and the push-out member pushes the first sheet of paper P1, the second sheet of paper P2, and the third sheet of paper P3 to output the first sheet of paper P1, the second sheet of paper P2, and the third sheet of paper P3 with the trailing edges thereof contacting the alignment member.

When the size of the paper P fed from the printer 2 into the holding tray 33, e.g., the length, width, and orientation of the paper P, is known, the post-processing controller 13 determines whether or not to feed the next sheet of paper P without outputting the sheet bundle PT in the holding tray 33. When determining to feed the next sheet of paper P without outputting the sheet bundle PT, a shift amount of the sheet bundle PT in the holding tray 33 is calculated.

The below descriptions focus on operation for the case of the mixed-printing. The configuration, function, and operation of each of the image forming apparatus 1 and the finisher 3 in the following description are just examples. The present invention is not limited to the examples. Various other embodiments may be made.

Referring to FIG. 3, the post-processing controller 13 is provided with an alignment control portion 13*a*, an output control portion 13*b*, and a stapler control portion 13*d* which control the alignment mechanism 136, the output mechanism 137, and the stapler 139, respectively. The correspondence relationship herein is conceptual relationship. A variety of configuration may be used in the actual units.

Referring to FIG. 4, the finisher 3 has the holding tray 33, a leading edge alignment guide 301, the trailing edge alignment guide 302, a front alignment guide 303, and the rear movable guide 304. The leading edge alignment guide 301 and the trailing edge alignment guide 302 function as alignment members for alignment in the FD-direction parallel with the paper feed direction M1. The front alignment guide 303 and the rear movable guide 304 function as alignment members for alignment in the CD-direction parallel with the output direction M2. The four alignment members and a non-illustrated driving portion for driving the four alignment members constitute the alignment mechanism 136. When the sheet bundle PT in the finisher 3 is outputted, the rear movable guide 304 is used as the push-out member for pushing out the sheet bundle PT to the paper output tray 36. In short, the rear movable guide 304 is also a structural element of the output mechanism 137.

Another configuration is possible in which two of rear movable guides 304 are provided side by side in the FD-direction. One of the rear movable guides 304 may be used as the alignment member, and the other may be used as the push-out member. In such a case, a driving portion both for the alignment process and the output process may be used to drive the two rear movable guides 304.

As shown in FIG. 4, on the right of the holding tray 33, an output portion 23 of the printer 2 is provided. The paper P sent out evenly with respect to the centerline TS by a paper output roller of the output portion 21B falls freely in the holding tray 33 and are fed into the holding tray 33. The holding tray 33 may be provided in the horizontal state. Alternatively, the holding tray 33 may be so inclined that the upstream (right side) in the paper feed direction M1 is lower than the downstream (left side).

The alignment operation for normal printing, namely, for the case where the sheets of paper P having the same size (sheets of paper having the same length, width, and orientation as one another), is performed in the following manner. Every time when paper P is fed into the holding tray 33, the front alignment guide 303 and the rear movable guide 304 outside a region where the paper P falls move so as to approach each other. The paper P is so set that the center of the paper P coincides with the centerline TS. This is an alignment process in the CD-direction. Then, one or both of the leading edge alignment guide 301 and the trailing edge alignment guide 302 move relative to each other so as to approach each other, and contact the both ends of the paper P to position the paper P. This is an alignment process in the FD-direction. Through the foregoing alignment processes, a plurality of sheets of paper P having the same size is positioned at the same position as one another in the holding tray 33.

The output operation for normal printing is performed in the following manner. The trailing edge alignment guide 302 is driven to move the sheet bundle PT to the left in the FD-direction. With this state maintained, the rear movable guide 304 is driven to move the sheet bundle PT to the front in the CD-direction. The sheet bundle PT in the holding tray 33 is pushed to the front in the CD-direction by the rear movable guide 304. The rear movable guide 304 moves wholly across the width of the holding tray 33 to output the sheet bundle PT to the paper output tray 36. At this time, the front alignment guide 303 is lowered or retracted so as not to interfere with the rear movable guide 304.

Figure 5:
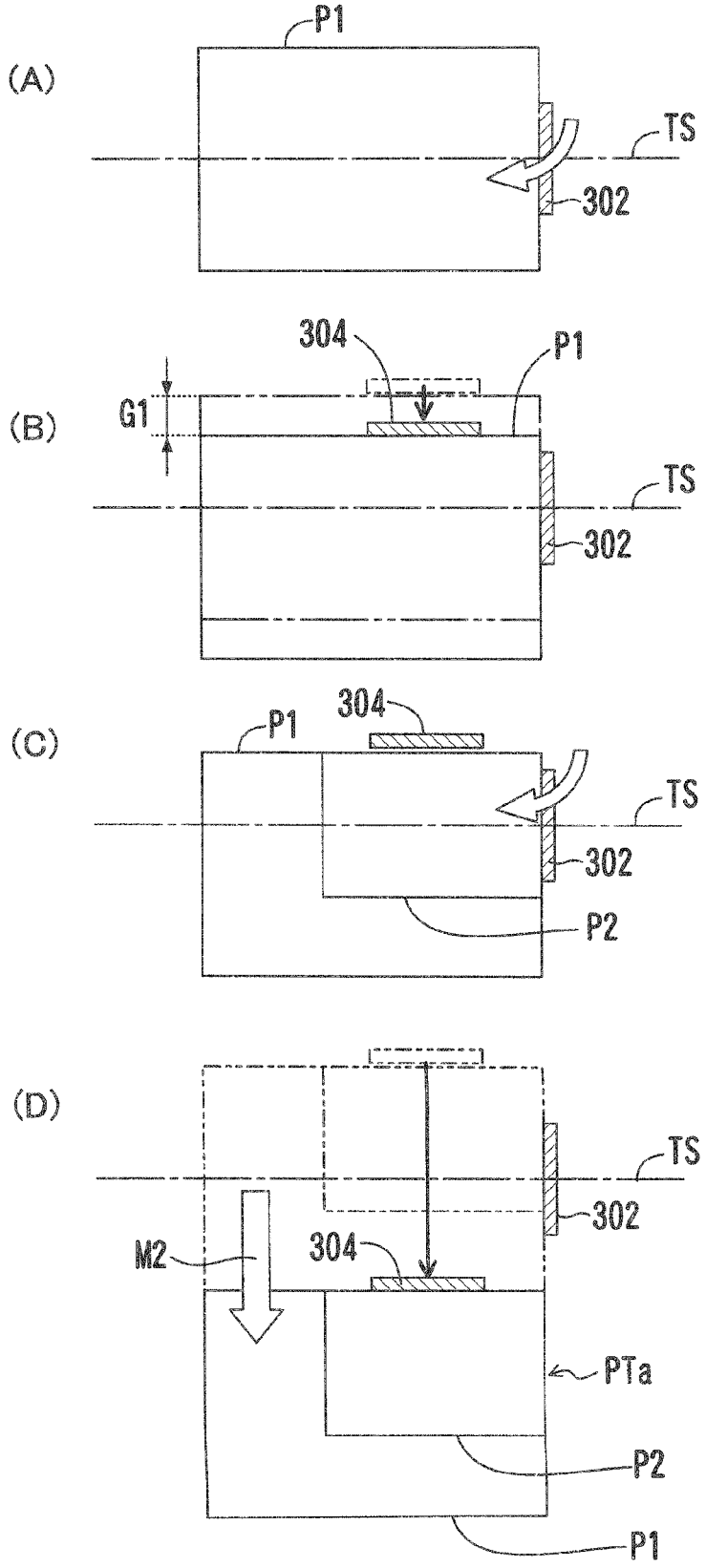
FIG. 5 is a diagram showing a first example of operation of a finisher in mixed-printing.
Figure 6:
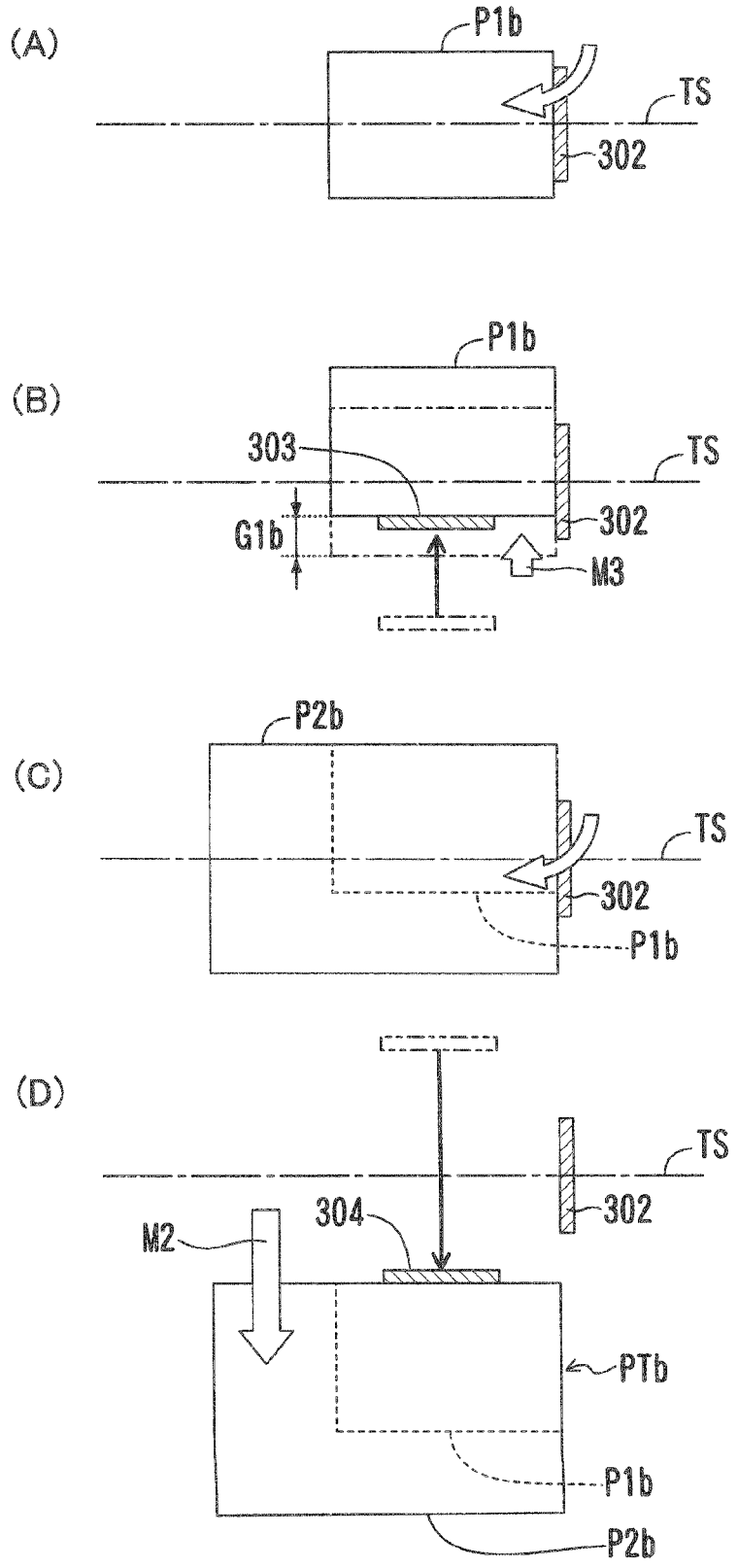
FIG. 6 is a diagram showing a second example of operation of a finisher in mixed-printing.
Figure 7:
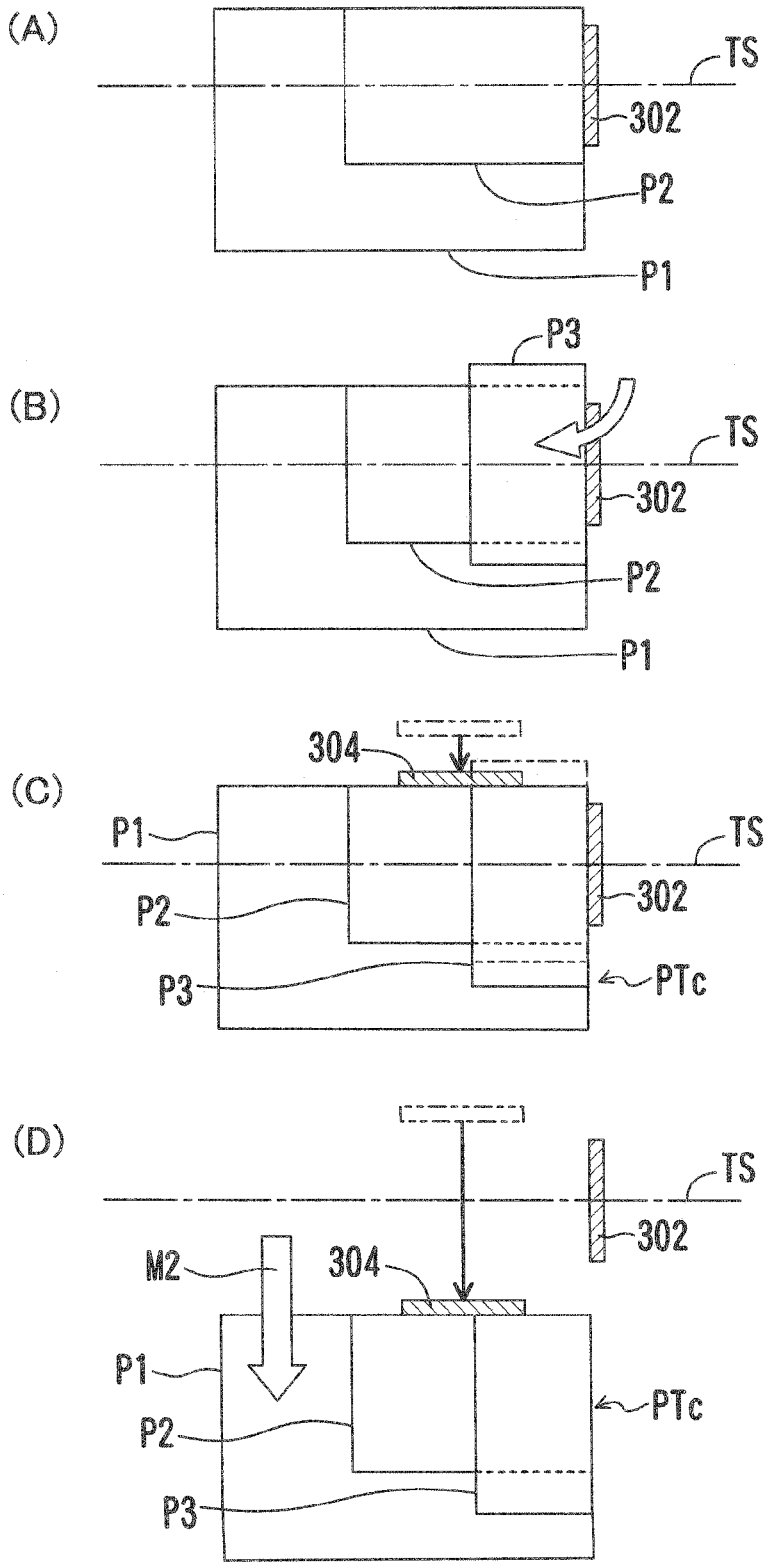
FIG. 7 is a diagram showing a third example of operation of a finisher in mixed-printing.

The description goes on to the operation of the finisher 3 for the case of the mixed-printing, namely, the case where sheets of paper P differing in width from one another are fed, by taking specific examples shown in FIGS. 5-7.

FIG. 5 shows operation of the finisher 3 for the case where the first sheet of paper P1 is fed, and then, the second sheet of paper P2 having a size smaller than that of the first sheet of paper P1 is fed. FIG. 6 shows operation of the finisher 3 for the case where a first sheet of paper P1*b* is fed, and then, a second sheet of paper P2*b* having a size larger than that of the first sheet of paper P1*b* is fed. FIG. 7 shows operation of the finisher 3 for the case where the first sheet of paper P1 is fed, then, the second sheet of paper P2 is fed, and thereafter, a third sheet of paper P3 having a width greater than that of the second sheet of paper P2 is fed. In this embodiment, both the sheets of paper P1 and P2 are fed in the longitudinal direction. Thus, if the width of the paper is large, then the size thereof is large. If the width of the paper is small, then the size thereof is small.

Referring to (A) of FIG. 5, the first sheet of paper P1 is fed. As described above, the paper feed into the finisher 3 is made through the paper central passage. At the time of the paper P being fed, the center of the first sheet of paper P1 in the width direction almost coincides with the centerline TS. The finisher 3 aligns the first sheet of paper P1 fed thereinto in the CD-direction and FD-direction. In the alignment in the FD-direction, the trailing edge of the first sheet of paper P1 contacts the trailing edge alignment guide 302, so that the first sheet of paper P1 is positioned.

In the illustrated example of FIG. 5, the length and width of the second sheet of paper P2 to be fed next to the first sheet of paper P1 are smaller than the length and width of the first sheet of paper P1. Even when the sheets of paper P1 and P2 fed in the stated order are different in size, unlike the conventional technologies, output operation only directed to the first sheet of paper P1 is not performed. Instead of not performing such output operation, the finisher 3 performs shift operation (preshifting) as shown in (B) of FIG. 5 to enable the second sheet of paper P2 to be fed.

Referring to (B) of FIG. 5, before the second sheet of paper P2 is fed, the post-processing controller 13 moves the rear movable guide 304 from the rear to the front to shift the first sheet of paper P1 in advance so that the side edge of the first sheet of paper P1 and the side edge of the second sheet of paper P2 are aligned. As shown in (B) of FIG. 5, the first sheet of paper P1 is preshifted to the output direction from the state where the center of the first sheet of paper P1 coincides with the centerline TS. The shift amount G1 is set to a half of the difference in width between the first sheet of paper P1 and the second sheet of paper P2, or, set to a value close to the half of the difference. The preshifting is performed while the trailing edge alignment guide 302 contacts the trailing edge of the first sheet of paper P1.

Referring to (C) of FIG. 5, the second sheet of paper P2 is fed and put on the first sheet of paper P1. Since the paper feed is made through the paper central passage, the center of the second sheet of paper P2 in the width direction almost coincides with the centerline TS. Because the first sheet of paper P1 is preshifted, the rear side edge of the first sheet of paper P1 and the rear side edge of the second sheet of paper P2 are aligned. After the second sheet of paper P2 is fed, the output operation is performed.

Referring to (D) of FIG. 5, the output operation is performed on a sheet bundle PTa of the first sheet of paper P1 and the second sheet of paper P2. The post-processing controller 13 moves the rear movable guide 304 to push out the sheet bundle PTa.

Prior to the output operation, the preshifting is performed to align the rear side edges of the sheets of paper. Therefore, in the course of the movement for the output operation, the rear movable guide 304 contacts the side edge of the first sheet of paper P1 and the side edge of the second sheet of paper P2 almost at the same time. After that, the first sheet of paper P1 and the second sheet of paper P2 are moved by the rear movable guide 304 with the side edges of the first sheet of paper P1 and the second sheet of paper P2 contacting the rear movable guide 304 and the trailing edges thereof contacting the trailing edge alignment guide 302. The trailing edge alignment guide 302 does not move for the output operation. The first sheet of paper P1 and the second sheet of paper P2 slide with respect to the trailing edge alignment guide 302. The trailing edge alignment guide 302 serves as a guide at the output of the first sheet of paper P1 and the second sheet of paper P2.

For the output operation, the sheet bundle PT is so moved that, of the four sides of the sheet bundle PT, one side of the sheet bundle PT along the output direction M2 and one side of the sheet bundle PT along a direction orthogonal to the output direction M2, namely, the two neighboring sides orthogonal to each other, contact the rear movable guide 304 and the trailing edge alignment guide 302. This prevents the first sheet of paper P1 and the second sheet of paper P2 smaller than the first sheet of paper P1 from skewing with respect to the output direction M2, and prevents the alignment from being impaired. This improves the appearance of the alignment of the outputted sheet bundle PT, and also prevents the first sheet of paper P1 and the second sheet of paper P2 from dropping out of the paper output tray 36.

In the illustrated example of FIG. 6, the length and width of the second sheet of paper P2*b* to be fed next to the first sheet of paper P1*b* are larger than the length and width of the first sheet of paper P1*b*. Even when the sheets of paper P1*b* and P2*b* fed in the stated order are different in size, the finisher 3 does not perform output operation only directed to the first sheet of paper P1*b*. Instead of not performing such output operation, the finisher 3 performs the preshifting.

Referring to (A) of FIG. 6, the first sheet of paper P1*b* is fed through the paper central passage. The finisher 3 aligns the first sheet of paper P1*b* in the CD-direction and in the FD-direction. For the alignment in the FD-direction, the trailing edge of the first sheet of paper P1*b* contacts the trailing edge alignment guide 302 and is positioned. The preshifting shown in (B) of FIG. 6 follows the alignment operation.

Referring to (B) of FIG. 6, before the second sheet of paper P2*b* is fed, the post-processing controller 13 moves the front alignment guide 303 from the front to the rear in the direction opposite to the output direction M2, i.e., in the backward direction M3, to shift the first sheet of paper P1*b*, so that the side edge of the first sheet of paper P1*b* and the side edge of the second sheet of paper P2*b* are aligned. As shown in (B) of FIG. 6, the first sheet of paper P1*b* is preshifted to the backward direction M3 from the state where the center of the first sheet of paper P1*b* coincides with the centerline TS. The shift amount G1 is set to a half of the difference in width between the first sheet of paper P1*b* and the second sheet of paper P2*b*, or, set to a value close to the half of the difference. The preshifting is performed while the trailing edge alignment guide 302 contacts the trailing edge of the first sheet of paper P1*b*.

Referring to (C) of FIG. 6, the second sheet of paper P2*b* is fed and put on the first sheet of paper P1*b*. Since the paper feed is made through the paper central passage, the center of the second sheet of paper P2*b* in the width direction almost coincides with the centerline TS. Because the first sheet of paper P1*b* is preshifted, the rear side edge of the first sheet of paper P1*b* and the rear side edge of the second sheet of paper P2*b* are aligned. After the second sheet of paper P2*b* is fed, the output operation is performed.

Referring to (D) of FIG. 6, the output operation is performed on a sheet bundle PTb of the first sheet of paper P1*b* and the second sheet of paper P2*b*. The post-processing controller 13 moves the rear movable guide 304 to push out the sheet bundle PTb.

As with the example of FIG. 5, in the illustrated example of FIG. 6, in the course of the movement for the output operation, the rear movable guide 304 contacts the side edge of the first sheet of paper P1*b* and the side edge of the second sheet of paper P2*b* almost at the same time. After that, the sheet bundle PTb is so moved that, of the four sides of the sheet bundle PTb, two neighboring sides orthogonal to each other keep contacting the rear movable guide 304 and the trailing edge alignment guide 302. This prevents the first sheet of paper P1*b* and the second sheet of paper P2*b* overlaid thereon from skewing with respect to the output direction M2, and also prevents the alignment from being impaired. This improves the appearance of the alignment of the outputted sheet bundle PTb, and also prevents the first sheet of paper P1*b* and the second sheet of paper P2*b* from dropping out of the paper output tray 36.

In the examples of FIGS. 5 and 6, the shift amounts G1 and G1*b* may be set to a value slightly greater than a half of the difference in width between the sheets of paper. This causes the rear movable guide 304 to first contact the sheets of paper P2 and P1*b* having an area smaller than the sheets of paper P1 and P2*b*, respectively. It is therefore possible to prevent the sheets of paper P1 and P2*b* having a larger area from dragging the sheets of paper P2 and P1*b* having a smaller area to be moved and inclined.

As with the example of FIG. 5, in the illustrated example of FIG. 7, the first sheet of paper P1 is fed, then, the second sheet of paper P2 is fed, and thereafter, the third sheet of paper P3 is fed. In the example of FIG. 7, no output operation is performed during a period from when the first sheet of paper P1 is fed to when the third sheet of paper P3 is fed.

As shown in FIG. 7, operation for receiving the third sheet of paper P3 without outputting the first sheet of paper P1 and the second sheet of paper P2 is performed only for the case where preshifting the second sheet of paper P2 is not necessary.

The case where preshifting the second sheet of paper P2 is not necessary is, for example, a case where, even if the third sheet of paper P3 is fed and the side edge of the third sheet of paper P3 is shifted from the side edge of the second sheet of paper P2, a sheet bundle PT including the third sheet of paper P3 can be outputted with the overlap of the sheet bundle PT kept. To be specific, the case where preshifting the second sheet of paper P2 is not necessary is a case where the third sheet of paper P3 has an area smaller than that of the second sheet of paper P2, and the side edge of the third sheet of paper P3 extends beyond the side edge of the second sheet of paper P2 at the time when the third sheet of paper P3 is fed. To be more specific, in the case where the third sheet of paper P3 is smaller than the second sheet of paper P2 and the third sheet of paper P3 has a width greater than that of the second sheet of paper P2, the third sheet of paper P3 is fed before the first sheet of paper P1 and the second sheet of paper P2 are outputted.

Referring to (A) of FIG. 7, the second sheet of paper P2 is put on the first sheet of paper P1. Alignment operation is performed in response to the second sheet of paper P2 fed, and the center of the second sheet of paper P2 in the width direction coincides with the centerline TS. Before the second sheet of paper P2 is fed, the alignment operation and the preshifting are performed on the first sheet of paper P1, and the side edge of the first sheet of paper P1 and the side edge of the second sheet of paper 2 are aligned.

Referring to (B) of FIG. 7, the third sheet of paper P3 is fed and put on the second sheet of paper P2. The third sheet of paper P3 has an area smaller than that of the second sheet of paper P2. The third sheet of paper P3 is larger in width than the second sheet of paper P2; therefore the rear side edge of the third sheet of paper P3 extends beyond the rear side edge of the second sheet of paper P2. The post-processing controller 13 moves the rear movable guide 304 to push out and output a sheet bundle PTc including the first sheet of paper P1, the second sheet of paper P2, and the third sheet of paper P3.

Referring to (C) of FIG. 7, outputting the sheet bundle PTc is started, and the first sheet of paper P1, the second sheet of paper P2, and the third sheet of paper P3 contact the rear movable guide 304. As is clear from the comparison between (B) and (C) of FIG. 7, in the course of the movement in the output direction M2, the rear movable guide 304 first contacts the third sheet of paper P3, pushes and moves the same. At this time, the second sheet of paper P2 is less likely to be dragged and moved because the third sheet of paper P3 has an area smaller than that of the second sheet of paper P2. Thus, among the first, second, and third sheets of paper P1, P2, and P3, only the third sheet of paper P3 moves. In short, the alignment is not impaired in this case.

Referring to (C) of FIG. 7, after the rear movable guide 304 contacts the first, second, and third sheets of paper P1, P2, and P3, the sheet bundle PTc moves together with the movement of the rear movable guide 304.

Referring to (D) of FIG. 7, the sheet bundle PTc is almost outputted. As with the examples of FIGS. 5 and 6, in the example of FIG. 7, the sheet bundle PTc is so moved that, of the four sides of the sheet bundle PTc, two neighboring sides orthogonal to each other keep contacting the rear movable guide 304 and the trailing edge alignment guide 302. This prevents the first, second, and third sheets of paper P1, P2, and P3 from skewing with respect to the output direction M2, and also prevents the alignment from being impaired. This improves the appearance the alignment of the outputted sheet bundle PTc, and also prevents the sheet bundle PTc from dropping out of the paper output tray 36.

The description goes on to the flow of the process operation by the finisher 3 with reference to flowcharts.

Figure 8:
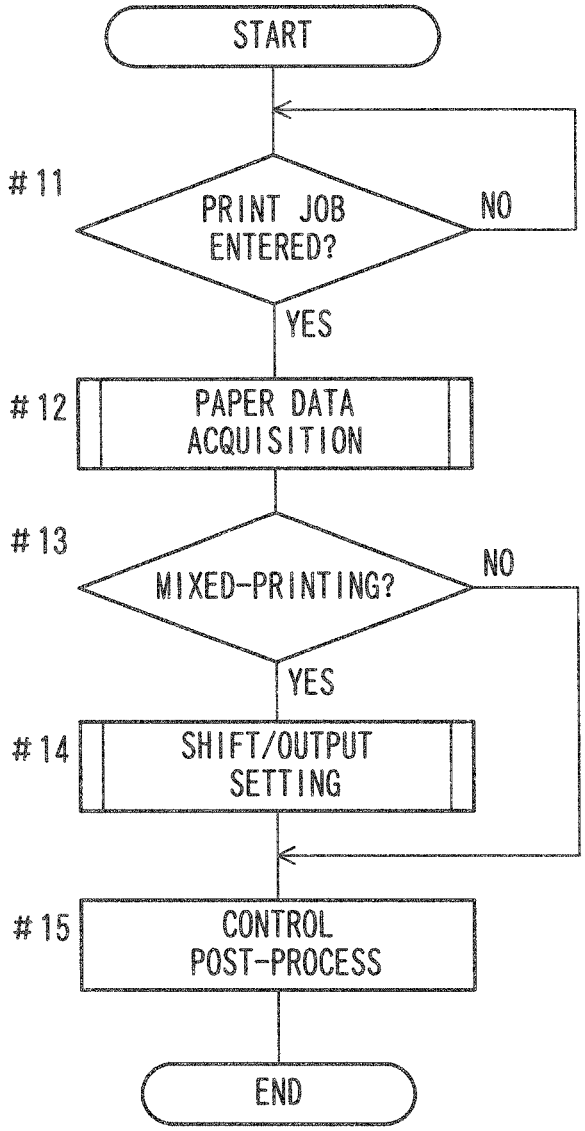
FIG. 8 is a flowchart for depicting an example of the outline of process operation by a finisher.

FIG. 8 shows the outline of process operation. The finisher 3 waits for a print job to be entered into the image forming apparatus 1 (Step #11). When the print job is entered, the main controller 11 notifies the post-processing controller 13 of the fact (YES in Step #11). The notification is, for example, a print preparation command C1. The post-processing controller 13 executes paper data acquisition which is processing of obtaining information on the number of sheets of paper P to be used for the print job, and the size of the paper P (Step #12).

If the print job designates the mixed-printing (YES in Step #13), then the post-processing controller 13 executes processing of shift/output setting routine (Step #14). In the routine, the necessity or lack of necessity of the preshifting, the shift amount G1, G1*b* for preshifting, and an output period (output time) of the sheet bundle PT are set in accordance with the size of the paper P.

After that, the post-processing controller 13 and the print controller 12 work in coordination to control the finisher 3 to apply a post-process to the sheet bundle PT in accordance with a pace of print operation of the printer 2 (Step #15). At this time, the post-processing controller 13 performs a control in such a manner that the preshifting and the output are performed in accordance with the setting details based on the shift/output setting routine.

In some cases, execution of a print job is started before completion of read-out of all the documents. One example of such cases is a copy job based on a multiple of document sheets. Stated differently, at the start of execution of a print job, the number of sheets of paper P is unclear, and whether or not the print job is the mixed-printing is also unclear. In such a case, the post-processing controller 13 executes the processing of Step #12 through Step #14 appropriately in parallel with the processing of Step #15 until the completion of read-out of all the documents is notified, and sets what kind of operation is to perform on a sheet of paper P determined to be fed.

Figure 9:
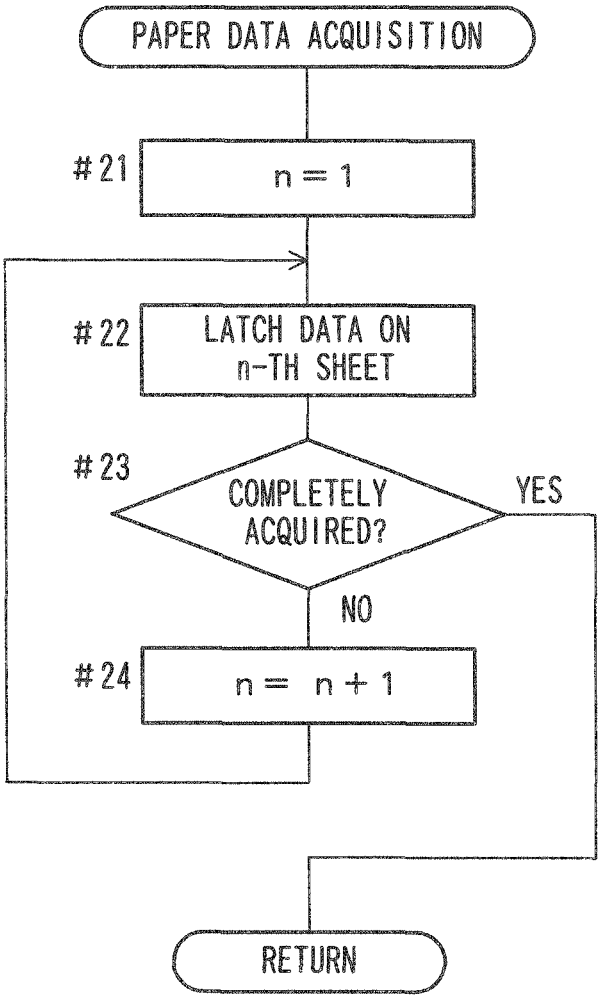
FIG. 9 is a flowchart of a paper data acquisition routine of FIG. 8.

FIG. 9 is a flowchart of the paper data acquisition routine of FIG. 8. The post-processing controller 13 sets, at "1", a value of variable "n" representing the paper-fed order of paper P of interest (Step #21). After that, the post-processing controller 13 obtains paper data related to the n-th paper P by extracting the same from print command information sent from the print controller 12. The post-processing controller 13 then stores the obtained paper data in correlation with the value of the variable "n" in a memory for temporary storage (Step #22). The paper data shows, for example, a sheet size and paper type.

As for each sheet of the paper P determined to be used for the print job, a check is made as to whether or not the paper data is completely acquired (Step #23). If the paper data has not yet been acquired (NO in Step #23), then the variable "n" is incremented (Step #24), and the process goes back to Step #22. If the paper data on each sheet of the paper P determined to be used for the print job is completely acquired (YES in Step #23), then the process returns to the routine of FIG. 8.

The paper data is used for determination as to whether or not the print job designates the mixed-printing, calculation of the amount of movement of the alignment member in the alignment process, determination as to whether or not the preshifting is required in the mixed-printing, or calculation of the shift amount G1, G1*b* for the preshifting.

Figure 10:
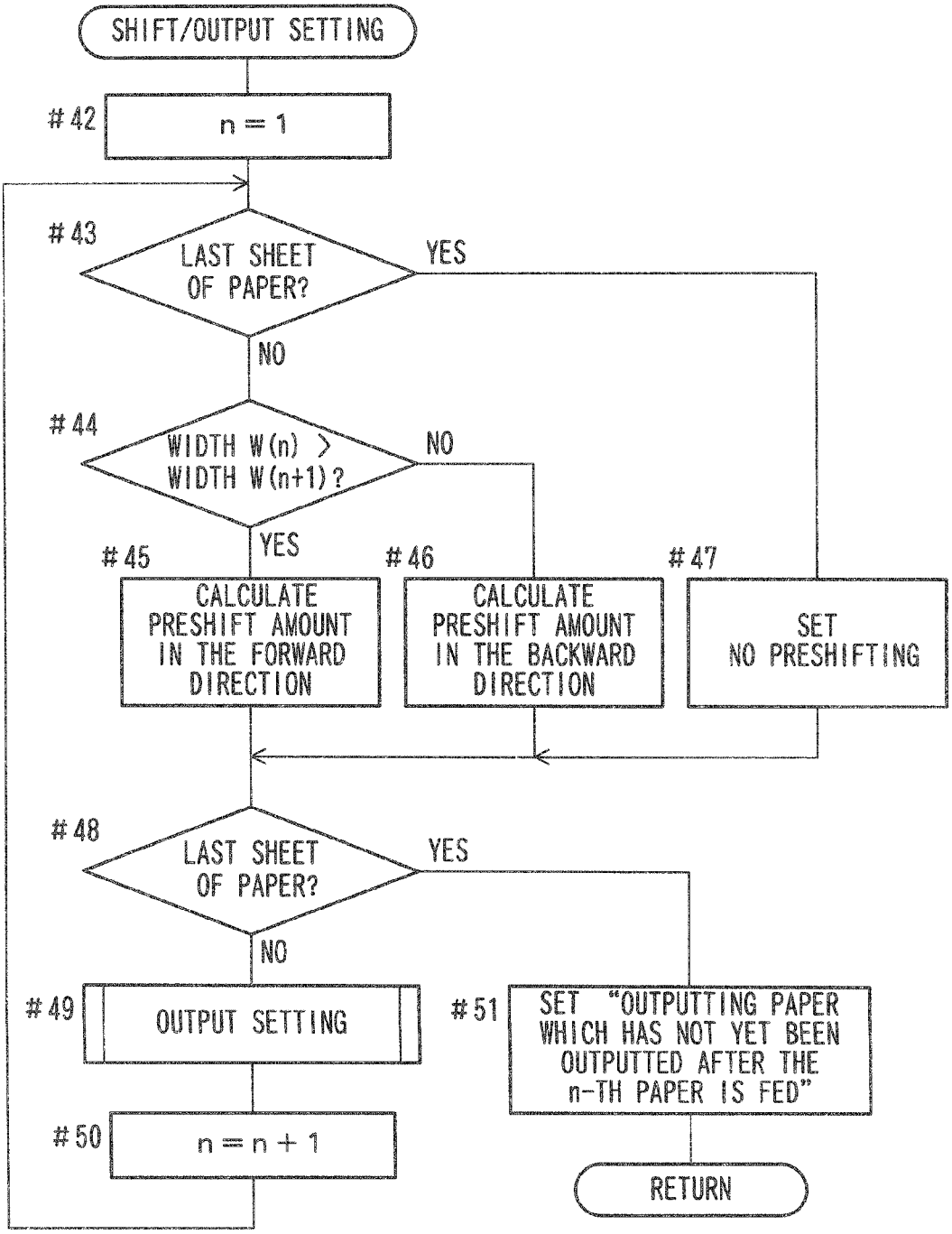
FIG. 10 is a flowchart of a shift/output setting routine of FIG. 8.

FIG. 10 is a flowchart of the shift/output setting routine of FIG. 8. As stated earlier, the routine is executed for the case of the mixed-printing. In the routine, for each sheet of the paper P to be used for the mixed-printing, whether or not the preshifting is necessary is determined. If it is determined that the preshifting is necessary, then the shift amount G1, G1*b* for the preshifting is calculated. Thereafter, an output time to perform the output operation, namely, the output operation is to be performed before or after which sheet of the paper P is fed is determined.

In the mixed-printing involving the use of three or more sheets of paper P, the sheets of paper P to be used sometimes include two or more sheets of paper P having the same size. The sheets of paper P having the same size are fed sometimes successively, or fed sometimes with a sheet of paper P having a different size interposed between the sheets of paper P having the same size.

First, the value of the variable "n" is set at "1" which is the initial value (Step #42). Then, the n-th paper P is made as a target to make necessary settings in the following manner.

It is checked whether or not the n-th paper P of interest is the last sheet of paper P, namely, the N-th paper, in the mixed-printing (Step #43). If the check result is "YES", then "no preshifing" is set for the n-th paper P (Step #47). Setting "no preshifting" for the paper P means determining not to perform the preshifting when the paper P is fed.

If the n-th paper P is not the last sheet of paper P (NO in Step #43), then it is checked whether or not the width W(n) of the n-th paper P is larger than the width W(n+1) of the (n+1)-th paper P which is to be fed next to the n-th paper P (Step #44).

If the size of the first sheet of paper P1 is larger than the size of the second sheet of paper P2 as shown in the example of FIG. 5, then the check result in Step #44 is "YES". If the check result is "YES" in Step #44, then the post-processing controller 13 calculates a shift amount G1 of preshifting for movement in the output direction (forward direction) M2, and stores the shift amount G1 in correlation with the variable "n" (Step #45). This means performing the preshifting by the shift amount G1 when the n-th paper P is actually fed.

If the size of the first sheet of paper P1*b* is smaller than the size of the second sheet of paper P2*b* as shown in the example of FIG. 6, then the check result in Step #44 is "NO". If the check result is "NO" in Step #44, then the post-processing controller 13 calculates a shift amount G1*b* of preshifting for movement in the backward direction M3, and stores the shift amount G1*b* in correlation with the variable "n" (Step #46). This means performing the preshifting by the shift amount G1*b* when the n-th paper P is actually fed.

In this description, a sign is attached to the shift amount G1, G1*b* to represent the direction of preshifting. For example, a "+" sign is added to the shift amount G1 in the output direction M2, and a "−" sign is added to the shift amount G1*b* in the backward direction M3.

After the determination as to the necessity or lack of necessity of the preshifting, the process goes to output time setting. It is checked first whether or not the n-th paper P of interest is the last sheet of paper P in the mixed-printing (Step #48). If the check result is "YES", then "outputting paper P which has not yet been outputted after the n-th paper P is fed" is set (Step #51). The setting makes it possible to feed a sheet bundle PT for the next print job after the n-th paper P is fed. In such a case, the process goes from Step #51 to the flow of FIG. 8.

In contrast, if the check result in Step #48 is "NO", then the post-processing controller 13 executes an output setting routine. In the output setting routine, an output time is determined in accordance with the relationship between the n-th paper P of interest and another sheet of paper P, and then, the variable "n" is incremented by "1", and the process goes back to Step #42.

Figure 11:
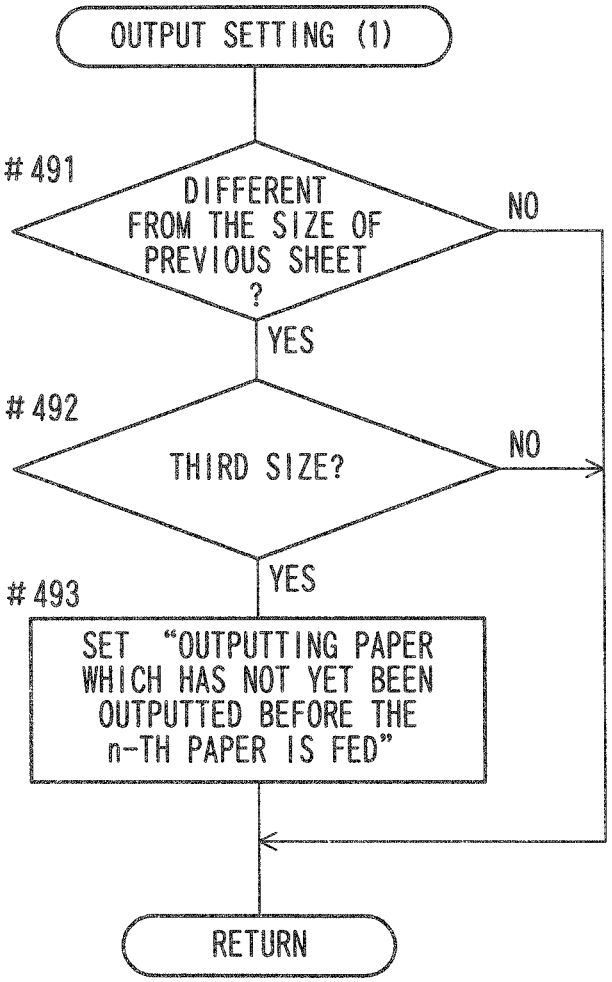
FIG. 11 is a flowchart for depicting a first example of output setting routine of FIG. 10.

FIG. 11 is a flowchart of a first example of the output setting routine.

It is checked whether or not the size of the n-th paper P of interest is different from the size of the (n−1)-th paper P which is fed immediately before the n-th paper P of interest (Step #491). If the check result is "NO", namely, if the size of the n-th paper P of interest is the same as that of the (n−1)-th paper P, then the process leaves the output setting routine immediately to go back to the flow of FIG. 10. In other words, when the sheets of paper P having the same size are fed successively, the process of leaving the output setting routine without making settings for output is repeated. Consequently, such control is performed that the output operation is not performed until all of the sheets of paper P having the same size are fed and all of the sheets of paper P having the same size are put in the holding tray 33.

If the check result in Step #491 is "YES", then it is checked whether or not the n-th paper P is paper P with a "third size" (Step #492). The third size herein means meeting a condition that "at least one sheet of paper P with a first size and at least one sheet of paper P with a second size put on the paper P with the first size have not yet been outputted, and the size of the n-th paper P of interest is different from the second size". In the condition, the size of the paper P of interest may be the same as the first size, or, alternatively, may be different therefrom. The total number of sheets of paper P which have not yet been outputted may be any number.

As for the condition, whether or not to "have not yet been outputted" is determined based on what kind of setting is made or not made at the past time of paying attention to each of the first through the (n−1)-th paper, in the case of paying attention to the first through the N-th paper. It should be noted that, in this embodiment, a period during which the output setting routine is executed is basically before the printer 2 starts conveying sheets of paper P for the mixed-printing, in other words, before the first sheet of paper P is fed into the finisher 3.

An example is taken in which at least two sheets of paper P have not yet been outputted. Suppose that attention is currently focused on the third sheet of paper. Suppose that, when the first sheet of paper has been focused, and when the second sheet of paper has been focused, the output period, e.g., before the feed of which paper P or after the feed of which paper P, has not been set. The fact that the output period is not set is equivalent to the fact of making a setting of "not outputting paper P of interest". In this case, therefore, the first and second sheets of paper P have not yet been outputted at this time when the third sheet of paper is focused.

If the check result in Step #492 is "NO", specifically, if the n-th paper P is not the paper P with the third size, then the process goes back to the flow of FIG. 10 immediately without making output setting.

In contrast, if the check result in Step #492 is "YES", specifically, if the n-th paper P is the paper P with the third size, then setting is so made of "outputting paper P which has not yet been outputted before the n-th paper P is fed" (Step #493). Stated differently, in order to avoid a situation where paper P which has not yet been outputted is present at the feed of the n-th paper P, setting is so made of performing outputting during a period from the feed of the (n−1)-th paper to the feed of the n-th paper P. The process then goes back to the flow of FIG. 8.

Figure 12:
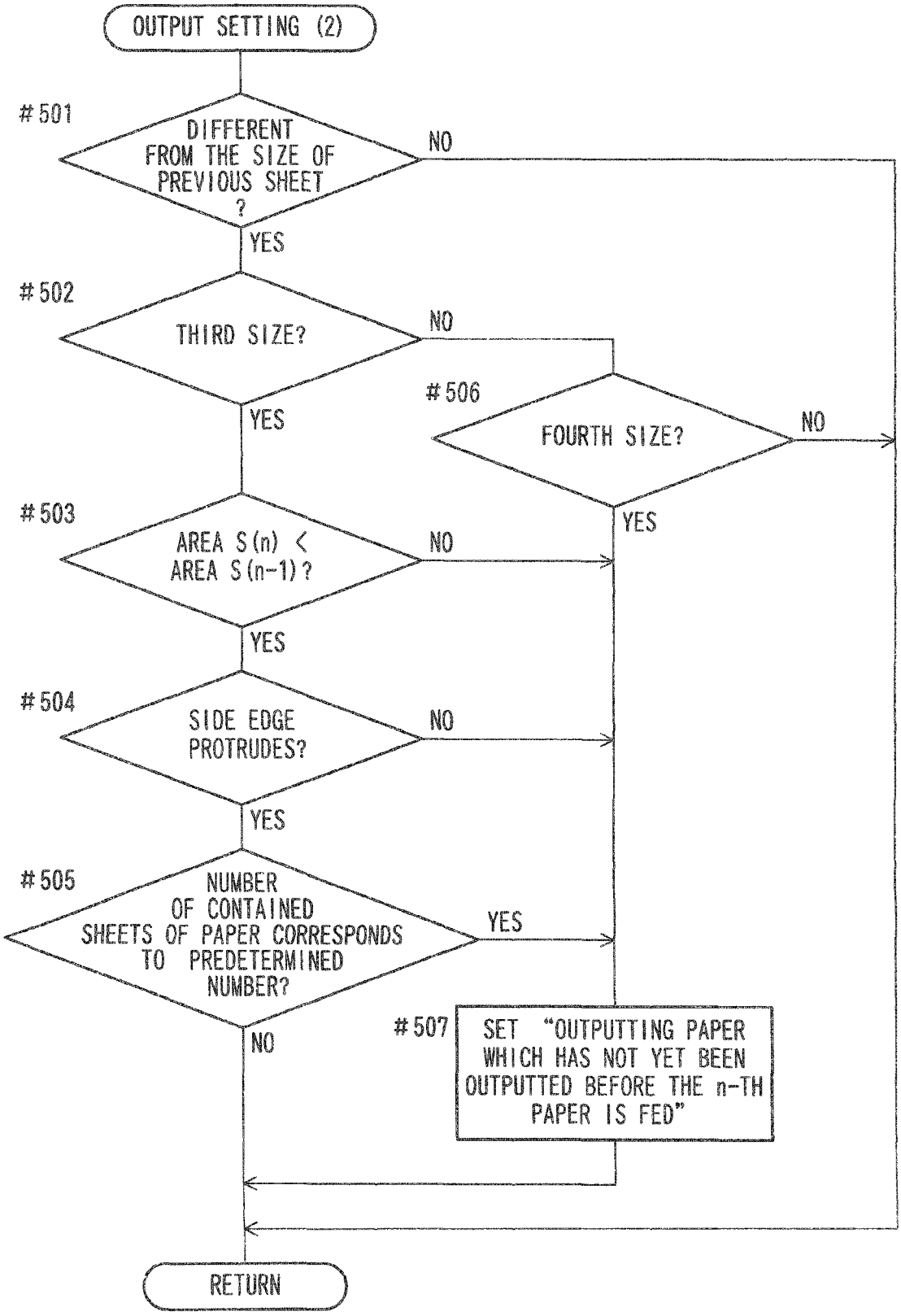
FIG. 12 is a flowchart for depicting a second example of output setting routine of FIG. 10.

FIG. 12 is a flowchart of a second example of the output setting routine.

In the first example of FIG. 11, a sheet bundle PT which has not yet been outputted is outputted before the paper P with the third size is fed. Therefore, the first, second, and third sheets of paper P having sizes different from one another do not overlap in the holding tray 33.

In contrast, in the second example of FIG. 12, when a predetermined condition is met, the feed of the paper P with the third size is accepted while the paper P with the first size and the paper P with the second size are put in the holding tray 33 without being outputted. In short, the second example implements the operation as that shown in FIG. 7. As compared with the first example, the second example has an advantageous effect of minimizing the number of times of output operation in the mixed-printing to improve the productivity.

Referring to FIG. 12, it is checked whether or not the size of the n-th paper P of interest is different from the size of the (n−1)-th paper P which is fed immediately before the n-th paper P of interest (Step #501). If the check result is "NO", namely, if the size of the n-th paper P of interest is the same as that of the (n−1)-th paper P, then the process leaves the output setting routine immediately to go back to the flow of FIG. 10.

If the check result in Step #501 is "YES", then it is checked whether or not the n-th paper P is paper P with the third size (Step #502). If the check result in Step #502 is "YES", then an output time is so set that the feed of the paper P with the third size is accepted while the previous paper P is put in the holing tray 33 without being outputted, provided that a predetermined condition is satisfied as described below.

The size of the paper P with the third size is the third size different from the first size and the second size. Alternatively, the size of the paper P with the third size is the same as the first size and is different from the second size.

An example of the check as to whether the predetermined condition is satisfied is to check whether or not an area S(n) of the n-th paper P of interest is smaller than an area S(n−1) of the (n−1)-th paper P (Step #503). At this time, if the paper data previously obtained contains data on area of each sheet of paper P, for example, if the paper data contains data on regular size such as A3, A4, or B5, then, it is possible to determine, directly based on the paper data, whether the area S(n) is smaller than the area S(n−1) or not. If the paper data does not contain data for identifying the area, and instead, contains numerical values indicating the length and width, then it is possible to determine whether the area S(n) is smaller than the area S(n−1) or not by calculating the area through multiplication based on the length and the width.

If the area S(n) is equal to or larger than the area S(n−1) (NO in Step #503), then it is determined that the predetermined condition is not satisfied. The reason for the determination is that, if the n-th paper P is put on the previous sheet bundle PT, the bundle is probably misaligned at a later output operation because the (n−1)-th paper P is dragged and moved by the n-th paper P.

If the check result in Step #503 is "NO", then "outputting paper P which has not yet been outputted before the n-th paper P is fed" is set (Step #507). Stated differently, in order to avoid a situation where paper P which has not yet been outputted is present at the feed of the n-th paper P, setting is so made of performing outputting during a period from the feed of the (n−1)-th paper to the feed of the n-th paper P. The process then goes back to the flow of FIG. 10.

If the check result in Step #503 is "YES", then it is checked whether or not the rear side edge of the n-th paper P of interest extends beyond the rear side edge of the sheet bundle PT which has not yet been outputted (Step #504). The rear side edge of the sheet bundle PT is to be positioned by preshifting to align the side edge of the paper P and the second size fed through the paper central passage. The (n−1)-th paper P is the paper with the second size. Therefore, the check in Step #504 can be made by comparing the width of the (n−1)-th paper P with the width of the n-th paper P. The case where the width of the n-th paper P is larger than the width of the (n−1)-th paper P corresponds to the case where the rear side edge of the n-th paper P extends beyond the rear side edge of the sheet bundle PT which has not yet been outputted.

If the check result in Step #504 is "NO", then the process goes to Step #507 in which "outputting paper P which has not yet been outputted before the n-th paper P is fed" is set.

If the check result in Step #504 is "YES", then it is checked whether or not the number of sheets of paper P (number of contained sheets of paper) which has not yet been outputted corresponds to a predetermined number (for example, 10 sheets) (Step #505). In view of the fact that alignment error and preshifting error are accumulated as the number of contained sheets is large, the check is so made to perform outputting before the error is getting large.

If the check result in Step #505 is "NO", then the process goes back to the flow of FIG. 10 immediately without making settings for output. The fact that no output setting is performed corresponds to the fact that setting is made of feeding the n-th paper P without outputting the sheet bundle PT in the holding tray 33.

In contrast, if the check result in Step #502 is "NO", then it is checked whether or not the n-th paper P is paper P with a "fourth size" (Step #506). The fourth size herein means meeting a condition that "the sheet bundle PT including the paper P with the third size has not yet been outputted, and the size of the n-th paper P of interest is different from the size of the paper P with the third size". In other words, the paper P with the fourth size is paper P which meets a condition that, counting from the time at which the paper P is first fed into the vacant holding tray 33, the number of times of change in size of paper P fed in sequence is "3".

If the check result in Step #506 is "YES", then it is determined that types of sheets of paper P contained in the sheet bundle PT are too many. The process then goes to Step #507 in which "outputting paper P which has not yet been outputted before the n-th paper P is fed" is set.

If the check result in Step #506 is "NO", then the size of the n-th paper P is the first size or the second size. In such a case, therefore, the preshifting can be performed on the previous paper P and outputting the previous paper P is not necessary as shown in the example of FIG. 5 or FIG. 6. The process therefore goes back to the flow of FIG. 10 immediately without making settings for output.

Figure 13:
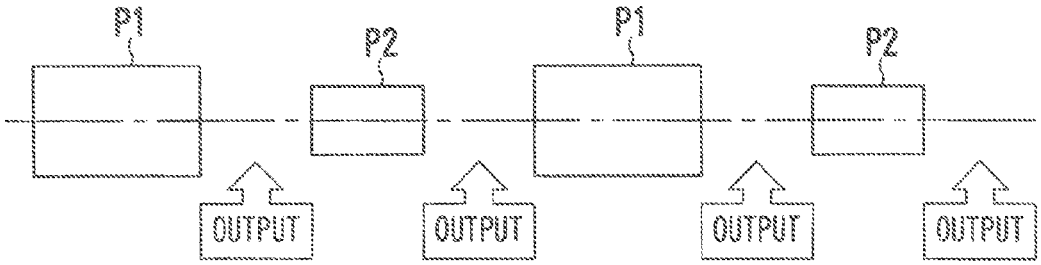
FIG. 13 Prior Art
FIG. 13 is a schematic diagram showing time reduction because of preshifting.
Figure 13:
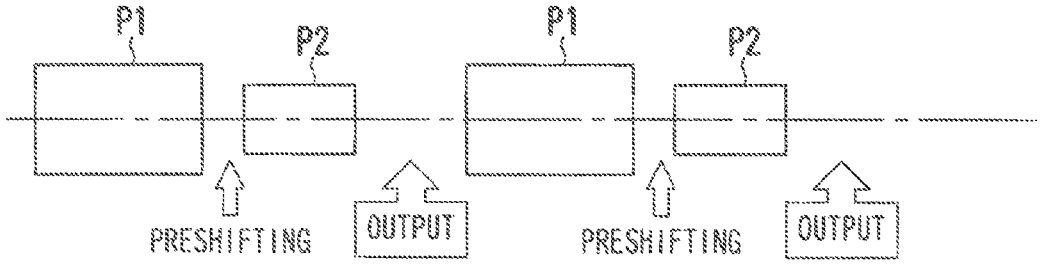
FIG. 13 Prior Art

FIG. 13 is a schematic diagram showing time reduction because of the preshifting. FIG. 13 shows, in (A), output timing in the case of conventional operation in which no preshifting is performed. FIG. 13 shows, in (B), output timing according to the present invention in which the preshifting is performed.

Referring to (A) of FIG. 13, when the paper P1 with the first size and the paper P2 with the second size are fed alternately, the outputting is performed every change in paper size. For example, in the mixed-printing using the total four sheets of paper P1 and P2, the outputting is performed four times.

On the other hand, referring to (B) of FIG. 13, when the paper P1 and the paper P2 are fed alternately, it is preferable to perform preshifting after the feed of the paper P1, and to perform outputting after the feed of the paper P2. In the mixed-printing using the total four sheets of paper P1 and P2, it is preferable to perform the preshifting twice and perform the outputting twice.

Performing the preshifting in this manner can reduce the number of outputting times by the number of preshifting times. Stated differently, it is possible to shorten the time allocated for outputting by setting the time for preshifting. As described later, the time required for one time preshifting is substantially shorter than the time required for outputting. Thus, the preshifting reduces the time required for the mixed-printing, so that the productivity of the mixed-printing is improved.

Figure 14:
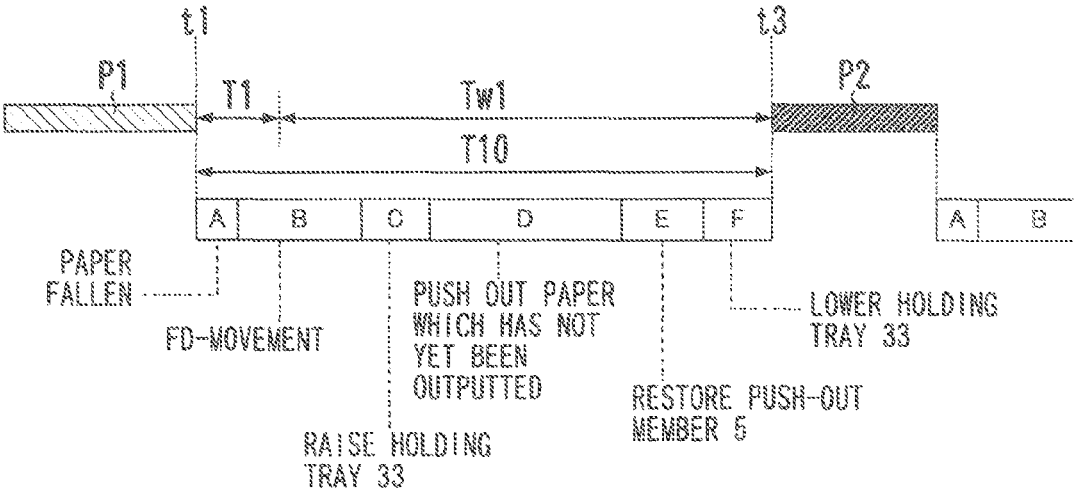
FIG. 14 is a timing chart for depicting time reduction because of preshifting.
Figure 14:
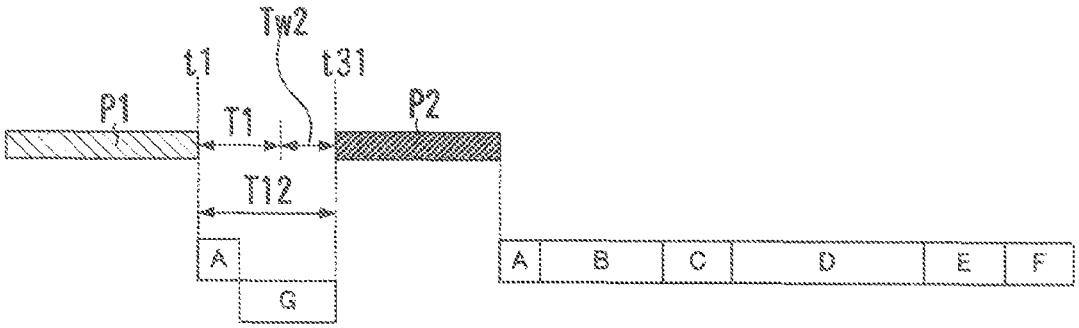

FIG. 14 is a timing chart for depicting time reduction because of the preshifting. FIG. 14 shows, in (A), a wait Tw1 in the case of conventional operation in which no preshifting is performed. FIG. 14 shows, in (B), a wait Tw2 according to the present invention in which the preshifting is performed.

Referring to (A) of FIG. 14, a series of output operation starts at a time point t1 after the paper P1 with the first size is fed. The output operation is divided into six stages of A, B, C, D, E, and F.

In the A-stage, the finisher 3 waits for the paper P1 sent out from the printer 2 to finish falling. The finisher 3 does not operate in the A-stage as seen from the outside.

In the B-stage, FD-movement for moving the sheet bundle PT containing the paper P1 to the output standby region of the holding tray 33 is performed (output preparation #1). In the B-stage, the prestacking mechanism 138 moves the prestack member to the operating position for the case of prestacking of temporarily housing the paper P to be fed.

In the C-stage, the posture of the holding tray 33 is so changed that one or both ends of the holding tray 33 in the FD-direction is raised to a position suitable for push-out (output preparation #2).

In the D-stage, the sheet bundle PT is pushed out from the holding tray 33 to the paper output tray 36 by means of a rear movable guide (press member) 304 (push-out).

In the E-stage, the rear movable guide 304 used for pushing out the sheet bundle PT is restored to the home position (feed preparation #1).

In the F-stage, the posture of the holding tray 33 is so changed that one or both ends of the holding tray 33 in the FD-direction is lowered to a position suitable for accepting paper feed (feed preparation #2). For the case where the prestacking mechanism 138 has moved the prestack member to the operating position, the prestacking mechanism 138 moves the prestack member to a retracted position in the F-stage.

Referring to (A) of FIG. 14, the second sheet of paper P2 having a size different from that of the first sheet of paper P1 is fed at a time point t3 when the output operation including the A-stage through the F-stage is completed and onward. A time T10 from the start time point t1 to the completion time point t3 of the output operation is much longer than the time T1. The time T1 is a conveyance time corresponding to a lower limit (minimum necessary value) of a gap between sheets (inter-sheet space) provided for the case where a plurality of sheets of paper 9 is conveyed sequentially. The time T1 is expressed by T1=Dmin/V wherein Dmin represents the lower limit of the inter-sheet space and V represents the system speed.

The difference between the time T10 and the time T1 is a wait Tw1. To be specific, as compared to the case where the finisher 3 does not perform the output operation, when the finisher 3 performs the output operation, conveyance of the paper P2 from the printer 2 to the finisher 3 is delayed by a time indicated in the wait Tw1.

On the other hand, a time T12 required for the preshifting is a time from the start of the A-stage to the end of the G-stage following the A-stage as shown in (B) of FIG. 14. In the G-stage, the rear movable guide 304 (for the case of shifting in the forward direction M2) or the front alignment guide 303 (for the case of shifting in the backward direction M3) is moved. The G-stage includes the restoration movement of the rear movable guide 304 or the front alignment guide 303.

The rear movable guide 304 or the front alignment guide 303 does not move, in the G-stage, in the entire length of the holding tray 33 in the width direction. Instead, in the D-stage, the rear movable guide 304 moves in the entire length of the holding tray 33 in the width direction. Therefore, the time required for the G-stage is shorter than the time required for the combination of the D-stage and the E-stage.

In short, the time T12 required for the preshifting is definitely shorter than the time T10 required for the series of output operation. Thus, the wait Tw2 for the case where the preshifting is performed is shorter than the wait Tw1 shown in (A) of FIG. 14.

Figure 15:
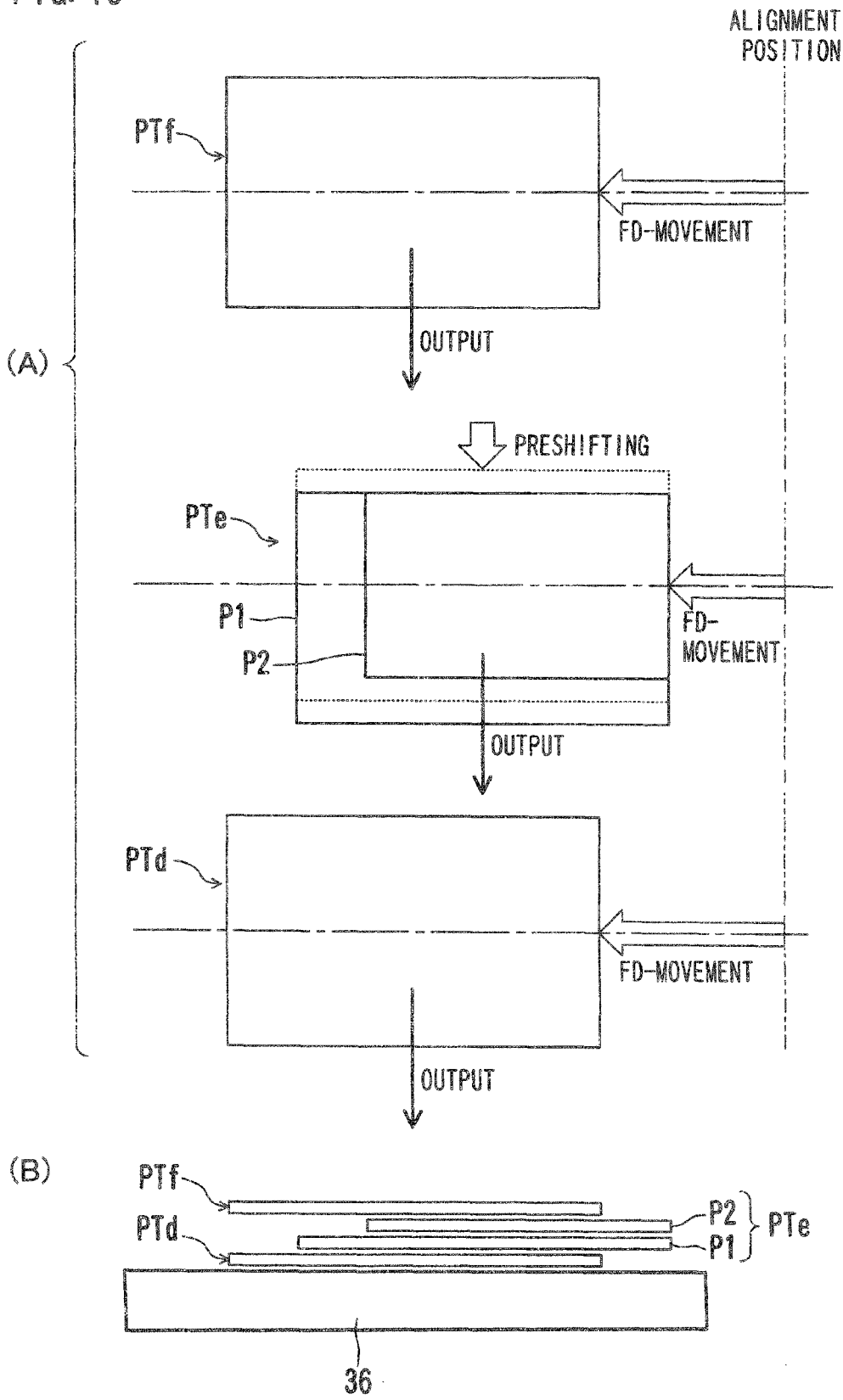
FIG. 15 is a schematic diagram showing shift paper output.

FIG. 15 is a schematic diagram of the shift paper output. FIG. 15 shows, in (A), three sheet bundles PTd, PTe, and PTf as viewed from the top. FIG. 15 shows, in (B), the three sheet bundles PTd, PTe, and PTf which are outputted to the paper output tray 36 and overlapped one another therein as viewed from the front.

The sheet bundle PTd, the sheet bundle PTe, and the sheet bundle PTf are outputted in the stated order. The sheet bundle PTd outputted first has one sheet of paper P. The sheet bundle PTf outputted third also has one sheet of paper P. The sheet bundle PTe outputted second is a sheet bundle PT related to the mixed-printing, and has a plurality of sheets of paper P1 and P2 having different sizes. The preshifting performed at the feed of the paper P1 of the sheet bundle PTe matches the rear side edges of the sheets of paper P1 and P2.

When each of the sheet bundles PTd, PTe, and PTf is outputted, the FD-movement for determining the position of each of the sheet bundles PTd, PTe, and PTf in the FD-direction on the paper output tray 36 is performed, prior to push-out to the paper output tray 36. The FD-movement moves the sheet bundles PTd-PTf to the left so as to be away from the position (alignment position) of the trailing edge at the end of the alignment process.

The movement amount of the FD-movement is changed every output. In the example of FIG. 15, a two-stage change is so made that the movement amount at the output of the odd-numbered sheet bundle is greater than the movement amount at the output of the even-numbered sheet bundle by a constant amount (1-3 cm, for example).

The FD-movement causes the trailing edges of the sheet bundles PTd and PTf to be shifted from the trailing edge of the sheet bundle PTd as shown in (B) of FIG. 15 in which the sheet bundles PTd, PTe, and PTf overlap one another. The leading edges of the paper P1 and the paper P2 of the sheet bundle PTe related to the mixed-printing are not aligned. The trailing edges of the paper P1 and the paper P2 are shifted from the trailing edges of the sheet bundles PTd and PTf.

In short, the shift paper output of shifting the sheet bundles PT is performed on the sheet bundles PT including the sheet bundle PTe related to the mixed-printing and the sheet bundles PTd and PTf. This makes it easy for a user to distinguish the sheet bundles PT from each other.

In the foregoing embodiment, the sheet bundle PT which has not yet been outputted is outputted before the paper P with the fourth size is fed. The present invention is not limited thereto. When the rear side edges of the sheets of paper P with the fourth size and onward extend beyond the side edge of the sheet bundle PT which has not yet been outputted, it is possible to feed the paper P with the fourth size and onward without outputting the sheet bundle PT which has not yet been outputted. This improves the productivity of the mixed-printing involving the use of sheets of paper P having different widths and sizes.

In the foregoing embodiment, it is to be understood that the configurations of the alignment mechanism 136, the output mechanism 137, the holding tray 33, the controllers 11-13, the finisher 3, the printer 2, and the image forming apparatus 1, the constituent elements thereof, the structure, the shape, the dimensions, the quantity, and the arrangement thereof, the content, order, and timing of the operation thereof, and the like can be appropriately modified without departing from the spirit of the present invention.

The prestacking mechanism 138 may be so structured that, when the trailing edge alignment guide 302 is driven by an FD conveying portion 371 to move to a predetermined position, the prestack member pivots to rise mechanically, and extends to turn into the operating state. The structure of the prestacking mechanism 138 is not limited to the exemplified structure, and the prestacking mechanism 138 may have another structure. The following structure is also possible. A prestacking driving portion having a motor, solenoid, or clutch may be provided separately, and may perform direct driving and control.

The holding tray 33 may be provided with a presser guide for pressing the sheet bundle PT at the time of the FD-conveyance. The holding tray 33 is so structured to have a leading edge side portion for supporting the sheet bundle PT at the output and a trailing edge side portion for supporting the sheet bundle PT at the feed and for prestacking. The trailing edge side portion is configured to switch its posture between the operating posture for the prestacking and the retracted posture for the feed.

The device of the preceding stage according to the present invention is not limited to one which feeds a sheet that has been subjected to printing. The mixed-printing processes involving the use of a plurality of sheets having different sizes may be a process other than printing, for example, may be application, coloration, surface treatment, and piercing.

While example embodiments of the present invention have been shown and described, it will be understood that the present invention is not limited thereto, and that various changes and modifications may be made by those skilled in the art without departing from the scope of the invention as set forth in the appended claims and their equivalents.

What is claimed is:

1. A post-processing device for applying a post-process to a sheet fed from a device of a preceding stage, the post-processing device comprising:

a holding tray configured to keep a sheet fed, from the device of the preceding stage, evenly with respect to a centerline of the device of the preceding stage;

an alignment mechanism configured to apply an alignment process to a sheet bundle of one or more sheets put in the holding tray;

an output mechanism configured to output the sheet bundle to a paper output tray by pushing a side edge of the sheet bundle put in the holding tray with a push-out member to move the sheet bundle in a direction orthogonal to a sheet feed direction; and a control unit;

wherein:

the control unit determines whether to change a position of a first sheet on the holding tray so that a side edge of the first sheet matches a side edge of a second sheet to be fed following the first sheet, in accordance with sizes of the first sheet and the second sheet, and in a case where the first sheet and the second sheet are different in size, the control unit performs a control in such a manner that the alignment mechanism or the output mechanism changes the position of the first sheet on the holding tray so that the side edge of the first sheet and the side edge of the second sheet match after the second sheet has been fed to the holding tray, and that, after the second sheet is fed, the output mechanism outputs the sheet bundle by pushing the side edges of the first and second sheets.

2. The post-processing device according to claim 1, wherein:

the control unit determines whether or not a size of a third sheet, which is a sheet fed after the second sheet, coincides with the size of the second sheet, and in a case where the size of the third sheet is different from that of the second sheet, the control unit performs a control in such a manner that, before the third sheet is fed, the sheet bundle including the first sheet and the second sheet is outputted.

3. The post-processing device according to claim 1, wherein:

the control unit determines whether or not or a size of a third sheet, which is a sheet fed after the second sheet, is different from the size of the second sheet, and determines whether or not the third sheet has an area larger than that of the second sheet, in a case where the size of the third sheet is different from that of the second sheet, and where the third sheet has an area larger than that of the second sheet, the control unit performs a control in such a manner that, before the third sheet is fed, the sheet bundle including the first sheet and the second sheet is outputted, and in a case where the size of the third sheet is different from that of the second sheet, and where the third sheet has an area smaller than that of the second sheet, the control unit performs a control in such a manner that, after the third sheet is fed, the sheet bundle including the third sheet, the first sheet, and the second sheet is outputted.

4. The post-processing device according to claim 1, wherein the control unit performs a control in such a manner that an alignment member of the alignment mechanism changes the position of the first sheet or the second sheet to match a trailing edge of the first sheet and a trailing edge of the second sheet in the sheet feed direction.

5. The post-processing device according to claim 4, wherein the control unit performs a control in such a manner that the push-out member pushes the side edge of the first sheet and the side edge of the second sheet to output the first sheet and the second sheet with the trailing edge of the first sheet and the trailing edge of the second sheet contacting the alignment member.

6. The post-processing device according to claim 5, wherein:

the control unit determines whether or not a size of a third sheet, which is a sheet fed after the second sheet, is different from the size of the second sheet, determines whether or not the third sheet has an area larger than that of the second sheet, and determines whether the side edge of the third sheet fed extends beyond the side edge of the second sheet, and in a case where the size of the third sheet is different from that of the second sheet, where the third sheet has an area smaller than that of the second sheet, and where the side edge of the third sheet fed extends beyond the side edge of the second sheet, the control unit performs a control in such a manner that the third sheet is fed, the alignment member aligns the trailing edge of the third sheet fed, the trailing edge of the first sheet, and the trailing edge of the second sheet, and the push-out member pushes and outputs the first sheet, the second sheet, and the third sheet with the trailing edges of the first sheet, the second sheet, and the third sheet contacting the alignment member.

7. The post-processing device according to claim 5, wherein:

the control unit determines whether or not a size of a third sheet, which is a sheet fed after the second sheet, is different from the size of the second sheet, and determines whether or not the third sheet has an area larger than that of the second sheet, and in a case where the size of the third sheet is different from that of the second sheet, and where the third sheet is larger than the second sheet, the control unit performs a control in such a manner that, before the third sheet is fed, the sheet bundle including the first sheet and the second sheet is outputted.

8. The post-processing device according to claim 1, wherein:

when a size of a next sheet to be fed from the device of the preceding stage into the holding tray is known, the control unit determines whether or not to feed the next sheet without outputting the sheet bundle put in the holding tray, and when the control unit determines to feed the next sheet without outputting the sheet bundle, a shift amount of the sheet bundle put in the holding tray is calculated.

9. The post-processing device according to claim 1, further comprising a prestacking mechanism configured to temporarily keep, in an upstream of the holding tray, a sheet to be fed next from the device of the preceding stage until the output mechanism outputs the sheet bundle.

10. An image forming apparatus comprising:

a printer configured to perform printing onto a sheet to convey the sheet to a post-processing device;

the post-processing device configured to apply a post-process to the sheet fed from the printer; and a control device configured to control the printer and the post-processing device; wherein:

the post-processing device includes a holding tray configured to keep a sheet fed, from the printer, evenly with respect to a centerline of the printer, an alignment mechanism configured to apply an alignment process to a sheet bundle of one or more sheets put in the holding tray, and an output mechanism configured to output the sheet bundle to a paper output tray by pushing a side edge of the sheet bundle put in the holding tray with a push-out member to move the sheet bundle in a direction orthogonal to a sheet feed direction;

the control device determines whether to change a position of a first sheet on the holding tray so that a side edge of the first sheet matches a side edge of a second sheet to be fed following the first sheet, in accordance with sizes of the first sheet and the second sheet, and in a case where the first sheet and the second sheet are different in size, the control device performs a control in such a manner that the alignment mechanism or the output mechanism changes the position of the first sheet on the holding tray so that the side edge of the first sheet and the side edge of the second sheet match after the second sheet has been fed to the holding tray, and that, after the second sheet is fed, the output mechanism outputs the sheet bundle by pushing the side edges of the first and second sheets.

11. The image forming apparatus according to claim 10, wherein:

the control device determines whether or not a size of a third sheet, which is a sheet fed after the second sheet, coincides with a size of the second sheet, and in a case where the size of the third sheet is different from that of the second sheet, the control device performs a control in such a manner that, before the third sheet is fed, the sheet bundle including the first sheet and the second sheet is outputted.

12. The image forming apparatus according to claim 10, wherein:

the control device determines whether or not a size of a third sheet, which is a sheet fed after the second sheet, is different from a size of the second sheet, and determines whether or not the third sheet has an area larger than that of the second sheet, in a case where the size of the third sheet is different from that of the second sheet, and where the third sheet has an area larger than that of the second sheet, the control device performs a control in such a manner that, before the third sheet is fed, the sheet bundle including the first sheet and the second sheet is outputted, and in a case where the size of the third sheet is different from that of the second sheet, and where the third sheet has an area smaller than that of the second sheet, the control device performs a control in such a manner that, after the third sheet is fed, the sheet bundle including the third sheet, the first sheet, and the second sheet is outputted.

13. The image forming apparatus according to claim 10, wherein the control device performs a control in such a manner that an alignment member of the alignment mechanism changes the position of the first sheet or the second sheet to match a trailing edge of the first sheet and a trailing edge of the second sheet in the sheet feed direction.

14. The image forming apparatus according to claim 13, wherein the control device performs a control in such a manner that the push-out member pushes the side edge of the first sheet and the side edge of the second sheet to output the first sheet and the second sheet with the trailing edge of the first sheet and the trailing edge of the second sheet contacting the alignment member.

15. The image forming apparatus according to claim 14, wherein:

the control device determines whether or not a size of a third sheet, which is a sheet fed after the second sheet, is different from a size of the second sheet, determines whether or not the third sheet has an area larger than that of the second sheet, and determines whether or not the side edge of the third sheet fed extends beyond the side edge of the second sheet, and in a case where the size of the third sheet is different from that of the second sheet, where the third sheet has an area smaller than that of the second sheet, and where the side edge of the third sheet fed extends beyond the side edge of the second sheet, the control device performs a control in such a manner that the third sheet is fed, the alignment member aligns the trailing edge of the third sheet fed, the trailing edge of the first sheet, and the trailing edge of the second sheet, and the push-out member pushes and outputs the first sheet, the second sheet, and the third sheet with the trailing edges of the first sheet, the second sheet, and the third sheet contacting the alignment member.

16. The image forming apparatus according to claim 14, wherein:

the control device determines whether or not a size of a third sheet, which is a sheet fed after the second sheet, is different from a size of the second sheet, and determines whether or not the third sheet has an area larger than that of the second sheet, and in a case where the size of the third sheet is different from that of the second sheet, and where the third sheet is larger than the second sheet, the control device performs a control in such a manner that, before the third sheet is fed, the sheet bundle including the first sheet and the second sheet is outputted.

17. The image forming apparatus according to claim 10, wherein:

when a size of a next sheet to be fed from the printer into the holding tray is known, the control device determines whether or not to feed the next sheet without outputting the sheet bundle put in the holding tray, and when the control device determines to feed the next sheet without outputting the sheet bundle, a shift amount of the sheet bundle put in the holding tray is calculated.

18. The image forming apparatus according to claim 10, further comprising a prestacking mechanism configured to temporarily keep, in an upstream of the holding tray, a sheet to be fed next from the printer until the output mechanism outputs the sheet bundle.

* * * * *